US008876604B2

(12) United States Patent
Casino et al.

(10) Patent No.: US 8,876,604 B2
(45) Date of Patent: Nov. 4, 2014

(54) HANDHELD ELECTRONIC GESTURE GAME DEVICE AND METHOD

(71) Applicant: BANG ZOOM design, Ltd., Cincinnati, OH (US)

(72) Inventors: Steven R. Casino, Maplewood, NJ (US); Michael G. Hoeting, Cincinnati, OH (US); Steven Fink, Cincinnati, OH (US); Robert W. Jeffway, Jr., Leeds, MA (US)

(73) Assignee: Bang Zoom Design, Ltd., Cincinnati, OH (US)

( * ) Notice: Subject to any disclaimer, the term of this patent is extended or adjusted under 35 U.S.C. 154(b) by 0 days.

(21) Appl. No.: 13/573,706

(22) Filed: Oct. 3, 2012

(65) Prior Publication Data

US 2013/0084979 A1 Apr. 4, 2013

Related U.S. Application Data

(60) Provisional application No. 61/542,568, filed on Oct. 3, 2011.

(51) Int. Cl.

| | |
|---|---|
| ***A63F 9/24*** | (2006.01) |
| ***A63F 13/00*** | (2014.01) |
| *A63F 11/00* | (2006.01) |

(52) U.S. Cl.

CPC ..... *A63F 9/24* (2013.01); *A63F 2009/2482* (2013.01); *A63F 2250/486* (2013.01); *A63F 2009/2402* (2013.01); *A63F 2009/2447* (2013.01); *A63F 2009/247* (2013.01); *A63F 2009/2452* (2013.01); *A63F 2011/0083* (2013.01)

USPC ..... 463/37; 463/1; 463/7; 463/36

(58) Field of Classification Search

CPC ..... A63F 13/00; A63F 13/02; A63F 13/06; A63F 13/10; A63F 2300/10; A63F 2300/1006; A63F 2300/105; A63F 2300/1037; A63F 2300/1043; A63F 2300/1062; A63F 2300/638; G07F 17/3202; G07F 17/3216; G05G 9/047

USPC ..... 463/30, 31, 46, 47, 7, 36–39

See application file for complete search history.

(56) References Cited

U.S. PATENT DOCUMENTS 4,360,345 A 11/1982 Hon
5,685,776 A * 11/1997 Stambolic et al. ..... 463/46

(Continued)

OTHER PUBLICATIONS

"Bop It iPhone and iPod Touch App Review!" by fishyy15. YouTube—Broadast Yourself. [dated Feb. 9, 2011], [online], [retrieved on Apr. 9, 2014]. <URL:http://www.youtube.com/watch?v=irJgl41Ns9U>. Still Image of Video. 2 Pages.*

(Continued)

*Primary Examiner* — Milap Shah

(74) *Attorney, Agent, or Firm* — Wood, Herron & Evans, LLP

(57) ABSTRACT

An electronic handheld gesture game device includes a game housing with a speaker and a plurality of lights to provide commands, feedback, and other information to a player. In one type of game play experience, the game device issues one or more commands that indicate a desired movement or gesture to perform, and the player must respond by moving the game housing to simulate the desired movement or gesture. The game device is self-contained and does not require outside computing devices or visual displays to perform the game play experiences.

21 Claims, 16 Drawing Sheets

(56) References Cited

U.S. PATENT DOCUMENTS

| | | | | |
|---|---|---|---|---|
| 5,816,580 | A * | 10/1998 | Osborne et al. | 273/454 |
| 5,893,798 | A * | 4/1999 | Stambolic et al. | 463/46 |
| 6,086,478 | A * | 7/2000 | Klitsner et al. | 463/35 |
| 6,150,947 | A | 11/2000 | Shima | |
| 6,210,278 | B1 * | 4/2001 | Klitsner | 463/35 |
| 6,626,728 | B2 | 9/2003 | Holt | |
| 6,848,992 | B2 * | 2/2005 | Adams | 463/9 |
| 7,022,036 | B2 * | 4/2006 | DuFlon et al. | 473/570 |
| 7,351,148 | B1 * | 4/2008 | Rothschild et al. | 463/30 |
| 7,367,887 | B2 | 5/2008 | Watabe et al. | |
| 7,445,550 | B2 | 11/2008 | Barney et al. | |
| 7,519,537 | B2 | 4/2009 | Rosenberg | |
| 7,896,742 | B2 * | 3/2011 | Weston et al. | 463/37 |
| 8,047,936 | B2 * | 11/2011 | DuFlon et al. | 473/570 |
| 2002/0058459 | A1 * | 5/2002 | Holt | 446/484 |
| 2002/0192626 | A1 | 12/2002 | Breimesser et al. | |
| 2004/0204240 | A1 * | 10/2004 | Barney | 463/36 |
| 2005/0210419 | A1 | 9/2005 | Kela et al. | |
| 2007/0033012 | A1 | 2/2007 | Rosenberg | |
| 2009/0262074 | A1 * | 10/2009 | Nasiri et al. | 345/158 |
| 2010/0134308 | A1 | 6/2010 | Barnardo et al. | |

OTHER PUBLICATIONS

Yonemoto, Tracy. "Bop It! Review" by AppSafari.com [online], [dated Feb. 4, 2011], [retrieved on Apr. 9, 2014]. <URL:http://www.appsafari.com/games/15372/bop-it/>. 9 Pages.*

* cited by examiner

HANDHELD ELECTRONIC GESTURE GAME DEVICE AND METHOD

CROSS-REFERENCE TO RELATED APPLICATION

This application claims the priority of Application Ser. No. 61/542,568, filed Oct. 3, 2011 (pending), the disclosure of which is hereby incorporated by reference herein.

TECHNICAL FIELD

This invention generally relates to a handheld game, and more particularly, to self-contained handheld electronic game devices and associated methods.

BACKGROUND

There have been many types of handheld or table top electronic games over the years. There have been different themes and game play mechanics involved with these games. One type of game play experience that has been popular is one in which the game device announces a command and the player has to respond to the command by pressing a button or physically manipulating a switch. The game continues with the sequence of commands in which the player responds. The input on these games includes an electrical contact which must be physically manipulated relative to the housing of the game device to establish a correct input. The game ends when the player or players cannot respond by manipulating the input in the correct sequence or within a predetermined time limit as instructed by the game device. These game devices are limited in how many different game play experiences can be generated because there are only so many types of physical input devices that can be provided on a handheld device.

Other types of game devices include video game consoles that receive input from cameras or controllers configured to sense motion and from optional physical switch inputs. The players of these game consoles are required to interact with a television or some other display screen to receive instructions and feedback on whether the appropriate inputs are being provided during a game play experience. As a result, additional hardware separate from the game console must be set up and connected to enjoy the game play experiences offered by the video game console. This additional hardware can be expensive, subject to incompatibility with the game console, and subject to failure that prevents a player from using the game console.

Therefore, it would be desirable to provide a handheld game device and associated method that addresses one or more of the drawbacks of these conventional game devices and consoles.

SUMMARY OF THE INVENTION

According to one embodiment of the invention, a method of operating a self-contained electronic handheld gesture game device includes generating an audible and/or visual prompt for a player to perform at least one gesture movement with the self-contained game device. The method also includes sensing at least two-dimensional movements of the game device with at least one sensor contained in the game device, and determining whether the sensed movements correspond to a known gesture movement. The method further includes generating audible, visual, and/or tactile feedback with the self-contained game device when the sensed movements correspond to a known gesture movement.

According to various aspects of the invention, the self-contained game device may operate a plurality of different game play experiences. A first game play experience, for example, may include actuating a speaker to generate the audible prompt for a desired gesture movement, detecting elapsed time while sensing movements, determining whether the sensed movements match the desired gesture movements, tracking points or penalties applied to the player, and actuating lights and/or the speaker to provide feedback to the player. In this regard, the first game play experience enables a Simon-says type of game play with gestures.

Other examples of game play experiences are also enabled. A second game play experience may enable a different type of Simon-says game involving memorization of light association with certain gestures. A third game play experience may enable a more complex and progressive type of game play by requiring sequences of gestures to be performed. A fourth game play experience may enable a type of freestyle music-making with the game device. A fifth game play experience may enable multiple players to experience the gesture response game play together. A sixth game play experience may enable a follow-the-leader type of game play with gestures. A seventh game play experience may enable more complex two-handed gestures to be used during game play. An eighth game play experience may enable more complex game play involving some word play with the gestures. A ninth game play experience may enable a competitive high scoring type of game play. A tenth game play experience may enable a competitive reaction race style of game play.

According to another embodiment of the current invention, an electronic handheld gesture game device includes an elongated housing including a handle and an interior space. The game device also includes at least one sensor located in the interior space and configured to detect at least two-dimensional movements of the housing. A speaker is located in the interior space and is configured to generate audible prompts and feedback for a player holding the housing. The game device further includes a controller located in the interior space and operatively coupled to the sensor and the speaker. The controller performs a series of operations including actuating the speaker to provide a prompt for the player to perform at least one gesture movement, determining whether sensed movements of the housing correspond to a known gesture movement, and actuating the speaker to provide feedback when the sensed movements correspond to a known gesture movement. The game device is self-contained and does not require interaction with sensors and feedback devices located outside the housing for the controller to perform the series of operations.

In one aspect, the game device further includes lights located in the interior space and configured to generate visual prompts and feedback for the player. The game device may also include a motor located within the interior space and configured to generate tactile feedback at the handle. The at least one sensor may include various types of sensors, such as a rotation detecting switch, a ball switch, a gravity switch, a tilt switch, or an accelerometer. The controller of the game device may be operable to perform each of the ten game play experiences described above. Therefore, the game device provides varied types of game play experiences without requiring connection to external unrelated hardware and devices.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

DETAILED DESCRIPTION

Figure 1:
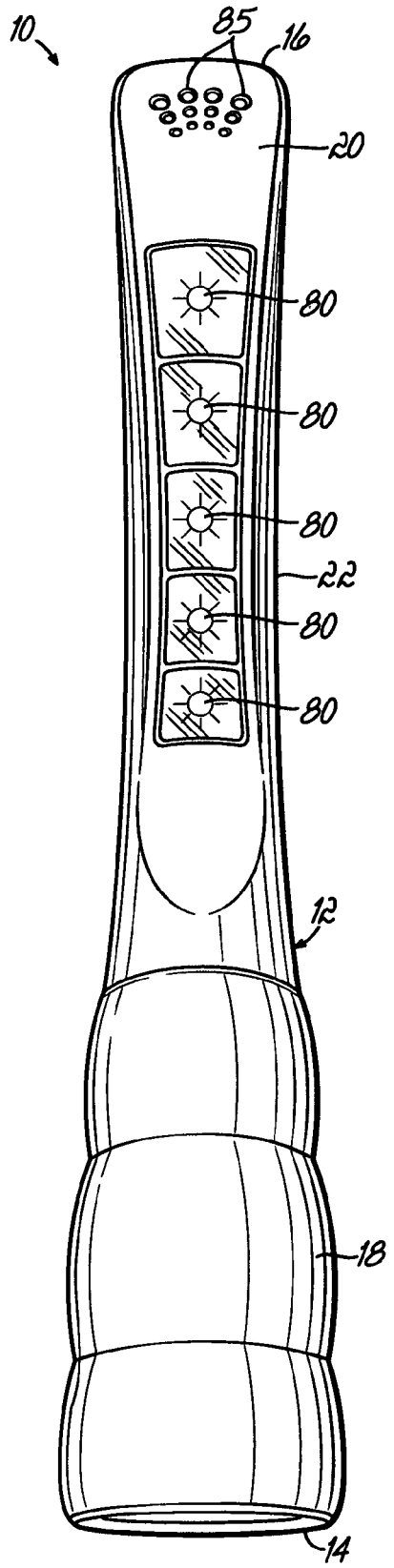
FIG. 1 is a front perspective view of a handheld gesture game device in accordance with one embodiment of the invention.
Figure 2:
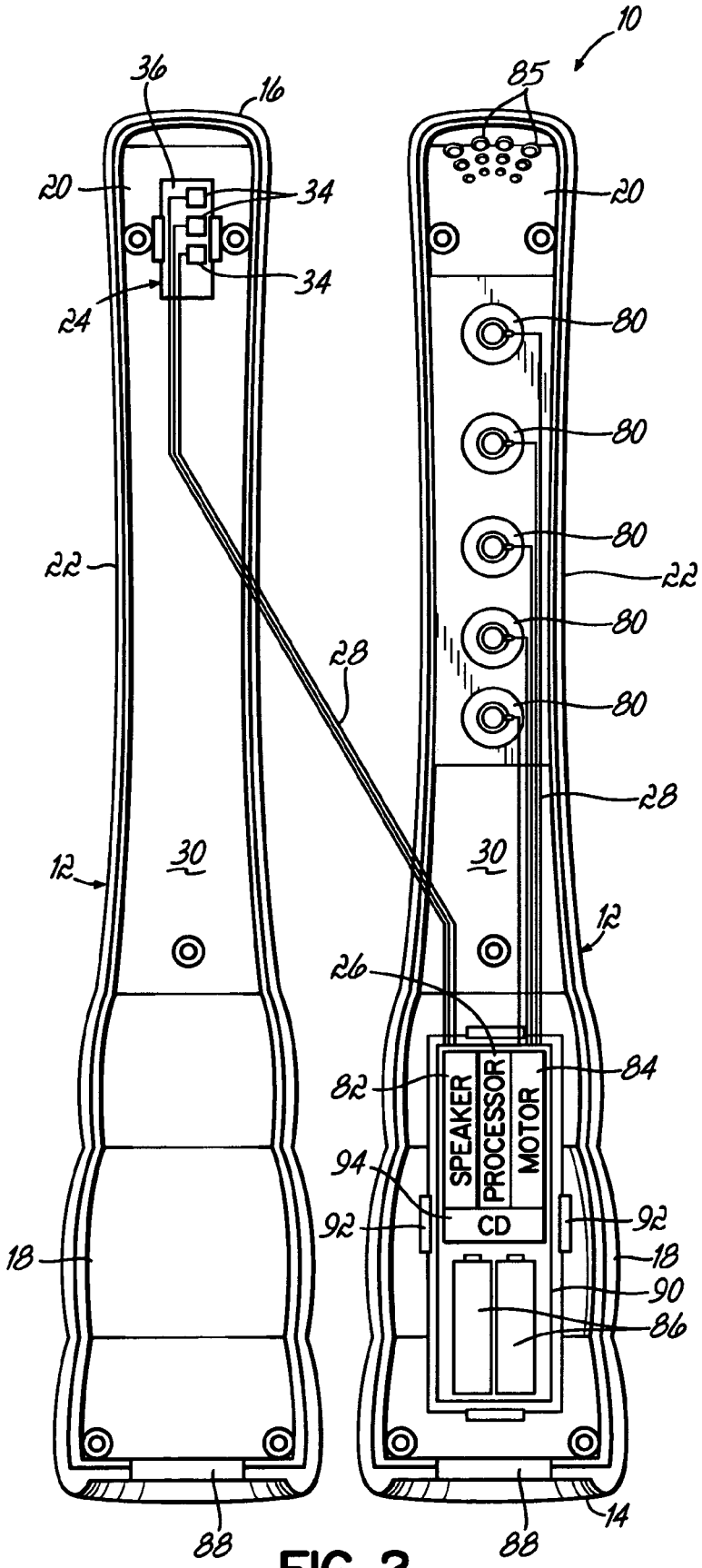
FIG. 2 is a front perspective view of the game device of FIG. 1, with a housing thereof split apart to reveal internal components.

With reference to FIGS. 1 and 2, one embodiment of a handheld electronic gesture game device 10 is shown. The game device 10 includes several play patterns in which a player responds to commands produced by the game device 10 in the form of an audible or visual (e.g., lights) output. Several examples of the play patterns enabled by the game device 10 are described in detail below with reference to the flowcharts of FIGS. 6 through 15. The game device 10 is advantageous because the game device 10 is self-contained, and the player input is not done by physically manipulating a switch or button, but rather, by moving the entire game device 10 to perform physical gestures.

Although several exemplary physical "gestures" are described below in the context of game play experiences, it will be appreciated that a "gesture" includes a particular movement of the game device 10 or a series of movements of the game device 10. For example, a gesture of "pour the drink" may include the series of movements defined by moving the game device 10 to a vertical orientation and then tipping the game device 10 in a similar fashion as one would a pitcher of liquid. As a result, the game device 10 is operable to perform game play experiences that are as highly varied as the different types of physical gestures that a player can make with the game device 10. By virtue of being "self-contained," no external display screen or other hardware is required to enjoy the game play experiences performed using the game device 10.

As shown in FIGS. 1 and 2, the game device 10 of this embodiment includes a housing 12 in the shape of a linear elongate wand. The housing 12 extends from a first end 14 to a second end 16, with a handle 18 being formed along the first end 14 for a player to hold during use of the game device 10. Although the handle 18 is shown with an arcuate bulbous profile, the handle 18 may be reshaped in accordance with other embodiments of the invention. The housing 12 also includes a sensor receptacle 20 formed at the second end 16 and a narrowed central portion 22 extending between the handle 18 and the sensor receptacle 20. The sensor receptacle 20 is configured to enclose one or more sensors 24 for detecting movements of the game device 10. In this regard, the one or more sensors 24 operate to provide input from a player to a controller 26 in the form of a processor, which is located within the handle 18 in the illustrated embodiment. The sensor 24 is connected to the controller 26 using cables 28 such as data-transmitting ribbon cables. To this end, the housing 12 of the game device 10 encloses the sensor 24, the controller 26, and the cables 28 in an interior pace 30 enclosed by the housing 12. This positioning of components prevents a player from inadvertently disconnecting or breaking these elements of the game device 10.

The sensor 24 located within the housing 12 may include one or more types of known sensing devices for determining at least two-dimensional and preferably three-dimensional movement. The sensor 24 for receiving movements converts inertia in a plane or in three-dimensional space into physical closure of electronic switches. The sensor 24 may also work by converting these movements into a higher resolution of data output based on the amount of inertia applied to the switch. For example, the sensor 24 can be a plurality of tilt switches 34 positioned in different orientations along a sensor board 36 as shown in FIG. 2. Alternatively, the sensor may include one or more of the following types of sensor: a rotation/torque detecting switch (discussed below with reference to FIG. 2A), a ball switch, a gravity switch, a tilt switch, a mercury switch, a multi-position ball switch (discussed below with reference to FIG. 2B), a shake switch, a solid state accelerometer, a solid state gyro, and other similar sensors. Regardless of the particular type of sensor 24 used, the movement direction and shifts in movement direction can be detected so that the gestures being performed with the game device 10 can be determined and analyzed. It will also be understood that the sensors 24 may be located in other positions within the housing 12 as well to enhance or modify the input received for the controller 26.

Figure 2A:
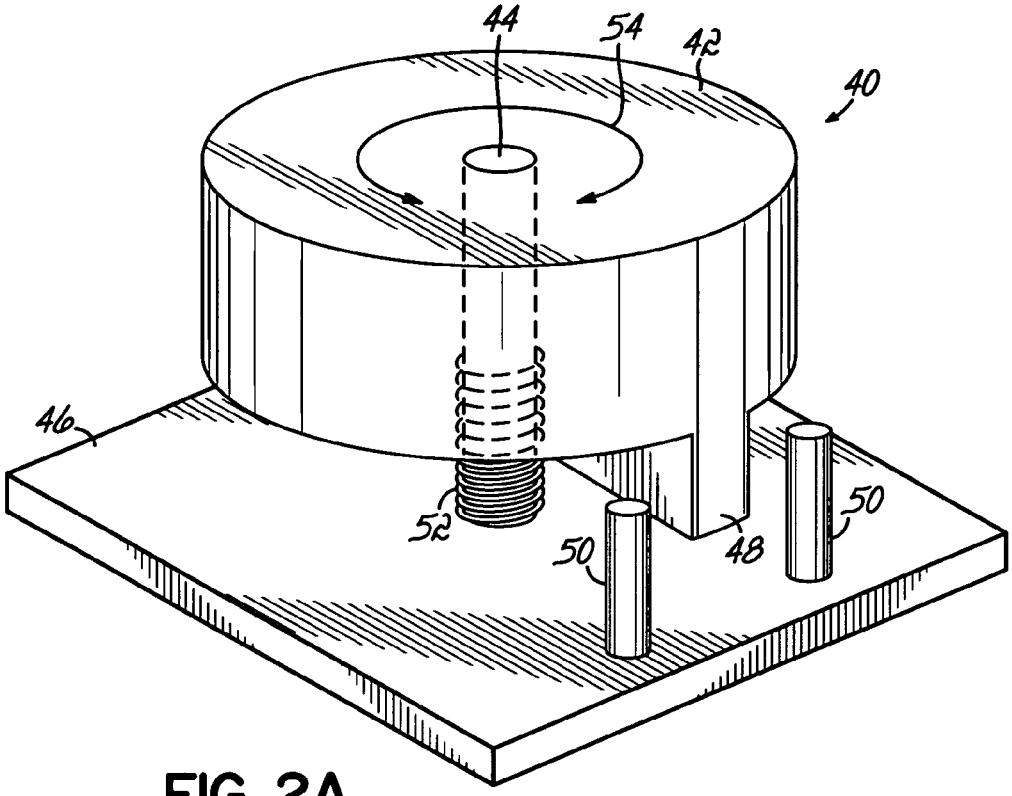
FIG. 2A is a perspective view of a sensor that may be used within the housing of the game device of FIG. 2.
Figure 2B:
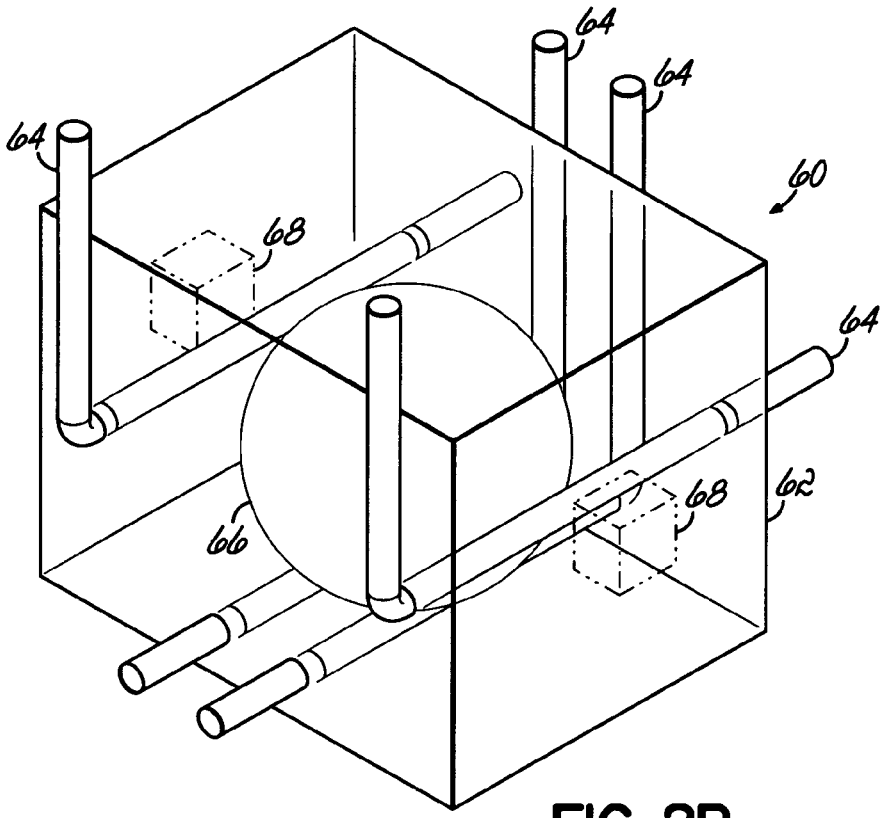
FIG. 2B is a perspective view of another sensor that may be used within the housing of the game device of FIG. 2.

With reference to FIGS. 2A and 2B, two alternatives to the individual tilt switches 26 shown in FIG. 2 are illustrated in further detail. The sensor shown in FIG. 2A is a rotation detecting switch 40 (may also be referred to as a torque detecting switch 40). The rotation detecting switch 40 includes a rotor 42 mounted on a support rod 44 extending upwardly from a base plate 46. The rotor 42 includes a closure fin 48 extending between two conductor rods 50, and also extending from the base plate 46. A biasing member 52, such as a torsion spring, is configured to hold the rotor 42 in a base position in which the closure fin 48 does not contact either of the conductor rods 50. When torque is applied by a player to rotate the housing 12, the rotor 42 is caused to rotate as shown by arrow 54 against the bias of the biasing member 52 so that the closure fin 48 contacts one of the conductor rods 50. This contact closes an electrical circuit that can be detected by a sensor board (not shown in FIG. 2A), and the direction and duration of rotations corresponding to the rotational movement applied can be determined from these signals. In other words, the rotational acceleration of the housing 12 is detected by the rotational inertia forcing the rotor 42 into contact with one of the conductor rods 50. As will be understood, multiple rotation detecting switches 40 may be mounted in different orientations within the housing 12 to provide rotation information in different directions.

The sensor shown in FIG. 2B is a multi-directional ball type gravity switch 60. The gravity switch 60 includes a hollow cube-shaped sensor housing 62, which includes a plurality of conductors 64 extending through the sensor housing 62. A ball 66, such as a silver plated ball bearing, is located within the hollow sensor housing 62 and is free to move into contact with any adjacent pair of conductors 64 extending through the sensor housing 62. Therefore, from the position of the ball 66 shown in FIG. 2B where the ball 66 contacts the two central conductors 64, movement of the gravity sensor 60 can cause the ball 66 to move left or right into contact with the left-most pair of conductors 64 or the right-most pair of conductors 64. Similar to the rotation detecting switch 40 described above, the ball 66 closes electrical circuits when it comes into contact with the conductors 64 and, therefore, the position of the ball 66 can be determined based on when the circuits using the various conductors 64 are closed. It will be understood that the simplified version of the gravity switch 60 shown may be modified to include more conductors 64 running in multiple directions to provide three-dimensional movement sensing with the gravity switch 60. In addition or alternatively, one or more pairs of sensors, such as Hall Effect sensors 68 (used with a magnetic ball 66) or optical energy emitters and sensors (where the ball 66 selectively blocks the optical path between the elements), can be used to determine the position of the ball 66 within the housing 62 at all times during movement of the game device 10. Therefore, one or more gravity switches 60 can be mounted within the housing 12 to provide movement information to the controller 26.

Returning to FIG. 2, additional components of the game device 10 are shown mounted within the housing 12. In addition to the sensor 24 and the controller 26, the game device 10 includes some combination of lights in the form of light emitting diodes (LEDs) 80, a speaker 82, and a motor 84 for providing commands and feedback to a player. It will be understood that the lights could include other types of lighting elements, including but not limited to incandescent bulbs, for example. The LEDs 80 are located along the central portion 22 to provide visual commands, feedback, or other information to the player. The speaker 82 produces audible commands, feedback, and other information to the player. To this end, the housing 12 may also include a screen or a plurality of small apertures 85 located adjacent the second end 16 for transmitting sound energy from the speaker 82 to the outside environment around the game device 10. The motor 84 drives vibration or some other tactile feedback in the handle 18 to provide visual or tactile feedback to the player as well. Each of these elements 80, 82, 84 is connected to the controller 26 via the cables 28 as shown, or by another known input/output port connection. It will be appreciated that any combination of these feedback elements 80, 82, 84 may be used with additional types of feedback elements in other embodiments within the scope of the current invention. In sum, the controller 26 of the illustrated embodiment receives sensed motions from the sensor 24 and is adapted to actuate one or more types of feedback from the LEDs 80, the speaker 82, and/or the motor 84.

As is well understood in handheld devices, the housing 12 also encloses a power supply, such as replaceable batteries 86 located within the handle 18. The first end 14 of the housing 12 may include an openable door 88 for enabling replacement of the batteries 86 when power runs out. The batteries 86 supply power to operate the other internal components of the self-contained game device 10. As briefly noted above, the benefits of being self-contained include not requiring power cords or some other external display screen devices to operate the game play experiences enabled by the game device 10. The batteries 86 in the embodiment of FIG. 2 plug into a "black box" 90 of electronics that may be assembled and then snapped into retention clips 92 in the interior space 30 of the housing 12. The "black box" 90 of this embodiment contains the controller 26, the speaker 82, the motor 84, and a receptacle for the batteries 86. The "black box" 90 may also include a communication device 94, such as a data cable receptacle or a wireless transmitter like a Bluetooth, for communicating with other linked game devices 10 in several of the game play experiences described below. It will be understood that more or fewer of the components located within the housing 12 may be provided in a snap-in "black box" 90 in other embodiments of the invention, and also that each of the components may be separately mounted and coupled to the housing 12 in other embodiments. Regardless of the particular positioning and mounting of components within the housing 12, the game device 10 remains self-contained.

Figure 3:
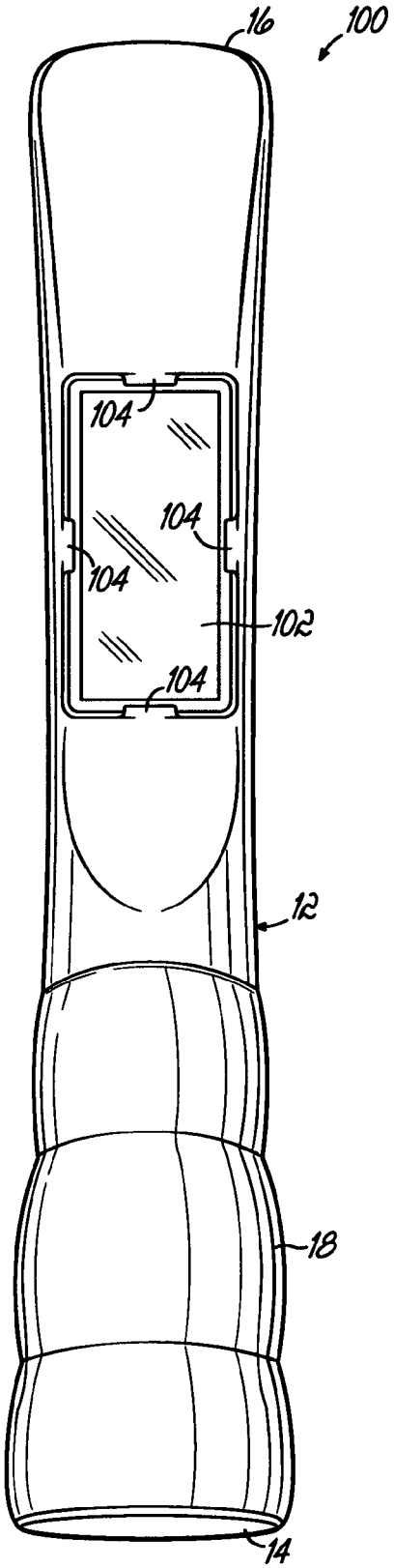
FIG. 3 is a front perspective view of a handheld gesture game device in accordance with another embodiment of the invention.
Figure 4A:
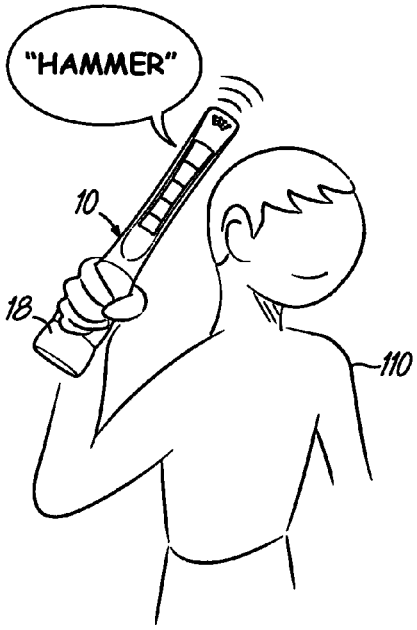
FIG. 4A is a front view of a player interacting with the game device of FIG. 1 during a first game operational state in which the game device commands the player to perform a gesture.
Figure 4B:
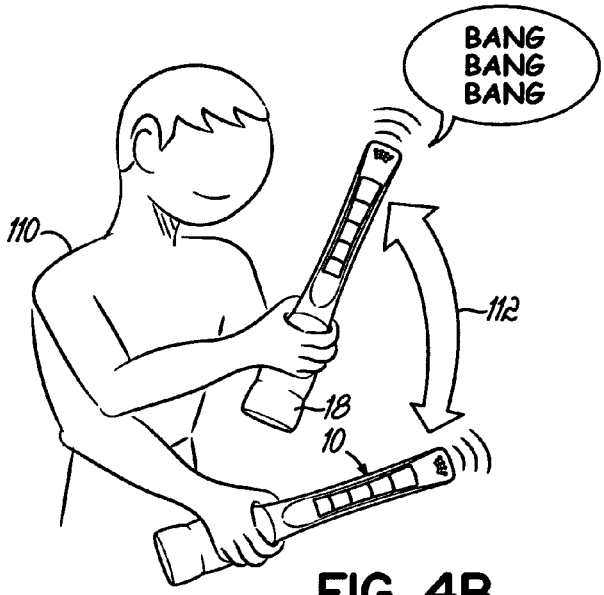
FIG. 4B is a front view of the player and game device of FIG. 4A during a second game operational state in which the player performs a gesture and the game device provides feedback.
Figure 4C:
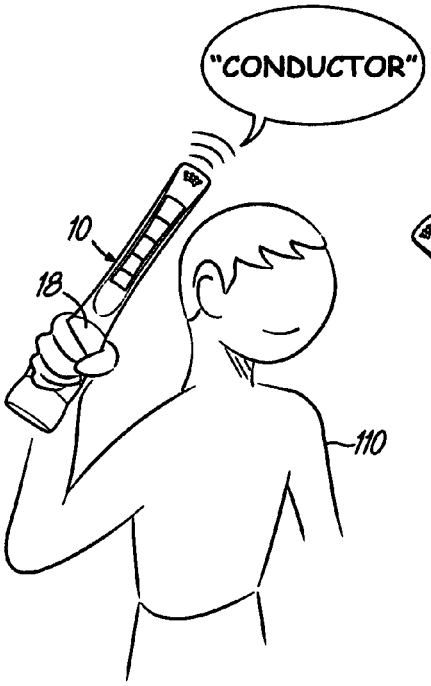
FIG. 4C is a front view of the player and game device of FIG. 4B during a third game operational state in which the game device commands the player to perform another gesture.
Figure 4D:
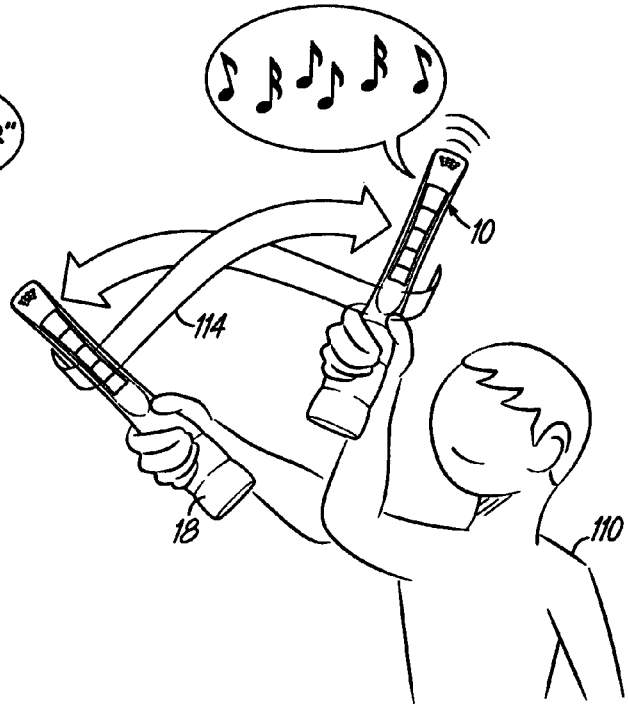
FIG. 4D is a front view of the player and game device of FIG. 4C during a fourth game operational state in which the player performs another gesture and the game device provides feedback.

Another embodiment of a game device 100 incorporating another idea using the "black box" concept is shown in FIG. 3. The game device 100 of this embodiment includes many of the same components described above with a slightly different arrangement of those components. Substantially identical elements have been provided with the same reference numbers in this embodiment. For example, the game device 100 still includes a housing 12 extending from a first end 14 with a handle 18 to a second end 16. In this embodiment, substantially all of the interior components (e.g., the sensors 24, the controller 26, the lights 80, the speaker 82, the motor 84, and the batteries 86) have been incorporated into a single black box 102 that may be separately assembled and then snapped into position using retention clips 104 provided on the housing 12. Depending on the particular embodiment, these retention clips 104 may be provided within the interior space 30 or along an outer periphery of the housing 12. The controller 26 within the black box 102 may be pre-loaded with software or an application that can be used to operate the game play experiences described in further detail below. However, the game device 100 remains self-contained as in the previous described embodiment.

In general operation, the controller 26 of the game device 10 (or 100) operates to produce a variety of gesture-related game play experiences. A plurality of flowcharts (FIGS. 5 through 15) showing a series of operations for some of these game play experiences is described in further detail below. In some of the game play experiences, the controller 26 actuates the speaker 82 or other components such as the LEDs 80 to prompt a player to make a gesture corresponding with that prompt. The LEDs 80 and/or speaker 82 may also be used to indicate how much time the player has remaining to perform the correct gestures, and to provide audible or visual feedback based on the gesture sensed by the sensors 24 within the game device 10. In games with a designated period of time in which the player needs to successfully match the series of movements to the game's command, if the time elapses before a matching gesture is made, then that event is recorded as a loss. Depending on the settings of the game device 10, one or more losses can end the game play experience.

One example of this general operation is shown with reference to FIGS. 4A through 4D. In this regard, a player 110 is shown holding the game device 10 in a first game operational state in FIG. 4A. In this first game operational state, the controller 26 actuates the speaker 82 to provide a command in the form of a word ("hammer"), and a timer may be started while the controller 26 monitors input movements sensed by the sensors 24. The player 110 then performs an action corresponding with this command, which in this case is a hammering up-and-down movement of the game device 10 as shown by arrow 112 in the second game operational state of FIG. 4B. In this second game operational state, audible feedback indicating a correct gesture may be provided by actuating the speaker 82 (the "bang bang" sound of hammering a nail is produced, for example). As described briefly above, the LEDs 80 and the motor 84 may also be used to provide additional types of feedback to the player 110. Following this correct gesture input, the controller 26 can repeat the process by actuating the speaker 82 to provide an additional command (the word "conductor") in a third game operational state shown in FIG. 4C. The player 110 then performs what he considers to be the corresponding gesture, a waving movement back and forth like a musical conductor as shown by arrow 114, in the fourth game operational state shown in FIG. 4D. When this correct gesture is detected by the sensors 24 and determined by the controller 26, another type of audible feedback may be provided by actuating the speaker 82 (e.g., music may play in this case). The game play experience continues until the player 110 fails to produce the desired gesture within a time limit set for that game play experience.

Other examples of commands that may be generated by the speaker 82 include actions such as "swing a bat" or "rev the motorcycle." As can be readily understood, the various types of gestures that can be performed with the game device 10 require the sensors 24 to accurately determine the current orientation and movement of the game device 10. The commands may be provided in various forms, including a noun, an action, or some other series of words that indicates a gesture to be performed with the game device 10. The commands that are produced by the game can be singular or in a series of multiple commands. In such an example, the player 110 has to respond accurately in the order in which the game requests when the series of multiple commands is offered. For example, the game device 10 may command "brush your teeth, but first swing a golf club, then hammer a nail." The player must then respond by moving the game housing to replicate the actions of swinging a golf club, brushing teeth, then hammering a nail, in that order.

Figure 5:
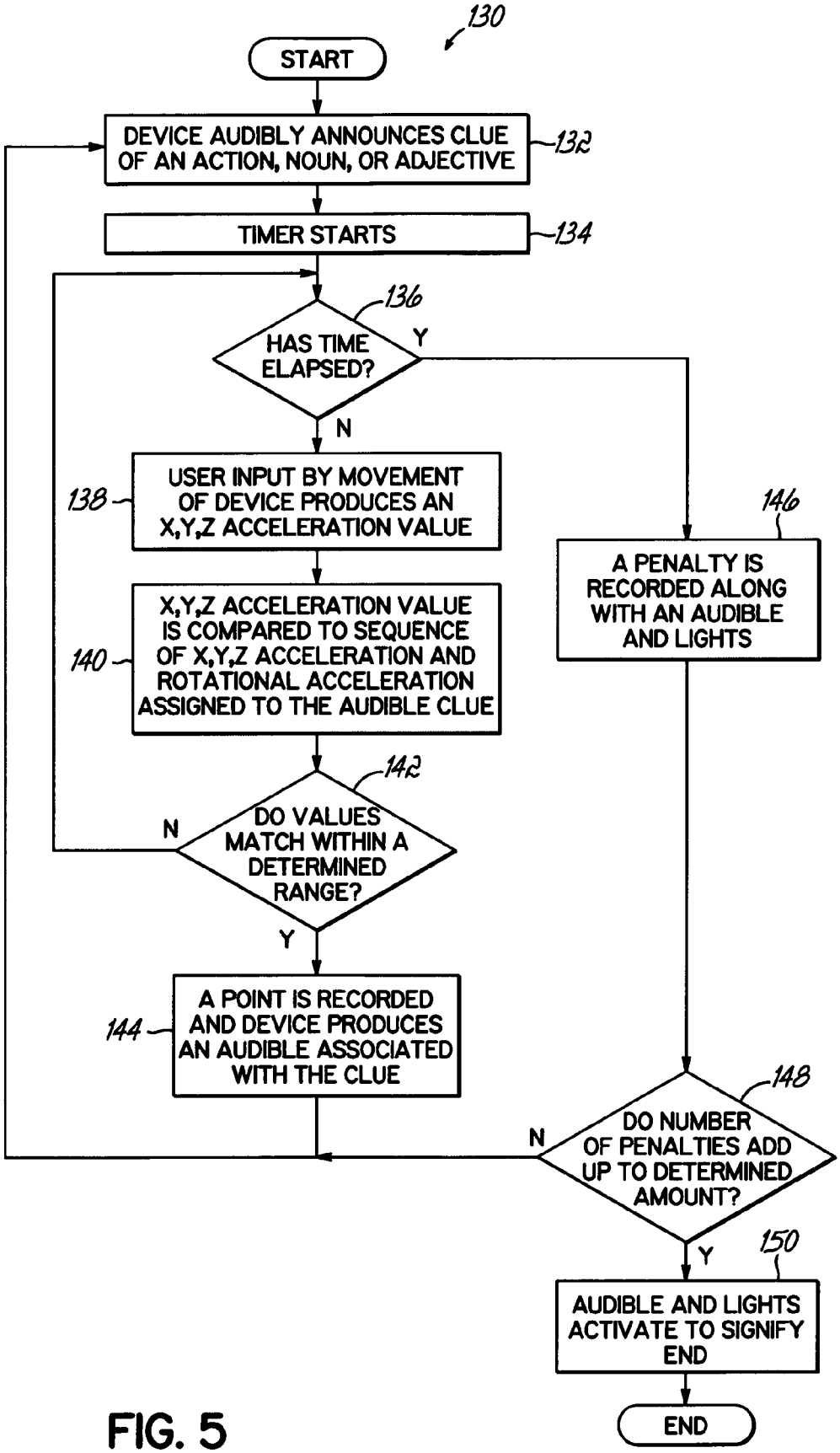
FIG. 5 is a flowchart showing an exemplary control sequence used with the game device of FIG. 1.

With reference to FIG. 5, a series of operations 130 is shown corresponding to a generalized control sequence for the game device 10. The series of operations 130 are operated using the controller 26. To this end, the controller 26 begins by prompting the game device 10 to audibly announce a clue in the form of an action, noun, or adjective (block 132). The controller 26 also starts a timer (block 134). The controller 26 then determines if a predetermined amount of time has elapsed (block 136). If the predetermined amount of time has not elapsed, then the controller 26 receives user input of gestures by determining the movements (e.g., the X, Y, Z acceleration value) sensed by the sensors 24 (block 138). This sensed movement is compared to values (e.g., a sequence of X, Y, Z acceleration and rotational acceleration) assigned to the correct gesture for the audible clue (block 140). The controller 26 then checks if these movement values match within a predetermined threshold that allows for differences in gesture inputs (block 142). If the movement values do not match, the controller 26 returns to block 136 to determine if the time has now elapsed. If the movement values do match, the controller 26 records a point being scored and actuates the speaker 82 to provide an audible signal corresponding to the correct gesture input (block 144). The controller 26 then returns to block 132 to provide a new clue.

If the controller 26 determines that the predetermined time has elapsed at block 136, then a penalty is recorded by the controller 26 and an optional audible/visual signal for this penalty may also be actuated via the speaker 82 and the LEDs 80 (block 146). The controller 26 then determines if the number of penalties recorded during this game add up to a predetermined amount for ending the game (block 148), and this number of penalties can vary based on the game play experience. If the number of penalties do not yet add up to the predetermined amount, then the controller 26 returns to block 132 to provide a new clue. If the number of penalties do add up to the predetermined amount, then the controller 26 actuates the speaker 82 and/or the LEDs 80 to provide an indication that the game is over (block 150), and then the series of operations 130 ends. In the simplified versions of the game play experiences described below, the same timing and point/penalty tracking can be used in association with the other particular operations of those game play experiences. These timing and tracking steps are not re-described in detail below, but it will be appreciated that these steps operate the same way as described here.

FIGS. 6 through 15 illustrate a plurality of series of operations that may be operated by the controller 26 of the game device 10 to produce distinct game play experiences. These game play experiences are just some of the numerous play modes that are enabled by the self-contained game device 10. As shown in detail below, these varied game play experiences illustrate the significantly unlimited potential applications of the game device 10 for gesture games.

Figure 6:
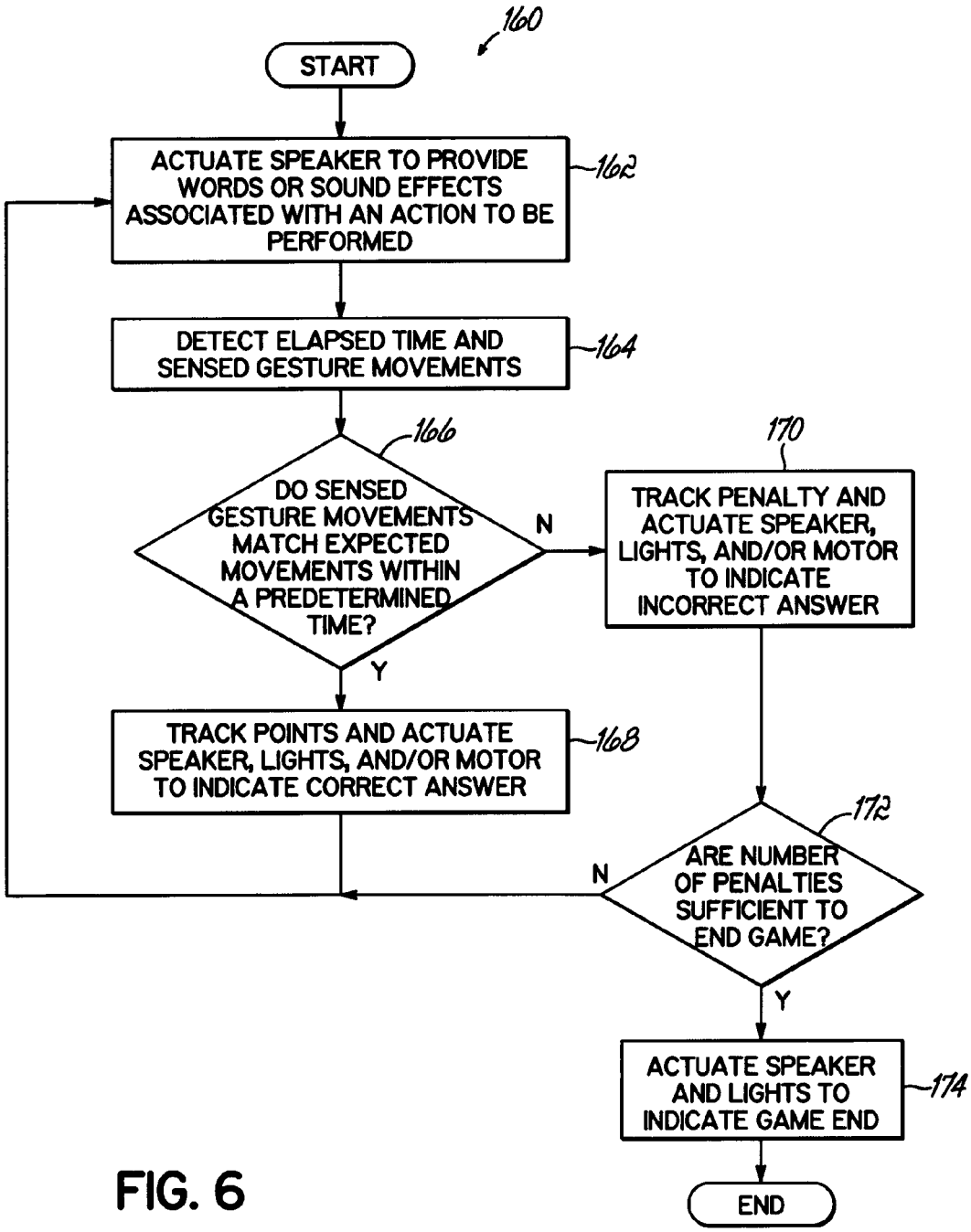
FIG. 6 is a flowchart showing a series of operations performed by the controller of the game device of FIG. 1 during a first type of game play experience.

A first game play experience may be entitled "follow the action/sound," which enables a type of Simon-says game play with gestures. FIG. 6 illustrates a corresponding series of operations 160 performed by the game device 10 during the first game play experience. As shown in that Figure, the controller 26 begins by actuating the speaker 82 to provide words or sound effects associated with an action to be performed (block 162). For example, the speaker 82 may be actuated to state a description of an action like "milk the cow." The controller 26 then detects the elapsed time since providing the command and any gesture movements sensed by the sensors 24 (block 164). The controller 26 determines whether the sensed gesture movements match the expected movements within a predetermined time (block 166). In the example of "milk the cow," the sensors 24 will detect whether the housing 12 is being held vertically and moved up and down with some twisting, similar to the gesture performed when milking a cow. The predetermined time may be a pre-set time dependent upon the particular difficulty of the game play experience desired. If the sensed gesture movements do match the expected movements, then the controller 26 tracks a point scored by the player 110 and actuates one or more of the LEDs 80, speaker 82, and motor 84 to indicate the correct gesture entry (block 168). For example, the LEDs 80 may illuminate green and a bell ringing noise may be emitted. The controller 26 then returns to block 162 to repeat the process of providing words or sound effects.

Instead, if the sensed gesture movements do not match the expected movements within the predetermined time, the controller 26 tracks a penalty applied to the player 110 for missing the gesture and then actuates one or more of the LEDs 80, speaker 82, and motor 84 to indicate the incorrect response (block 170). For example, the LEDs 80 might illuminate red and a buzzer sound may be emitted. The controller 26 then determines if the number of penalties assessed to the player 110 is sufficient to end the game (block 172). If not, the controller 26 returns to block 162 to repeat the process of providing words or sound effects. If the number of penalties is sufficient to end the game, then the controller 26 actuates the speaker 82 and/or the LEDs 80 to indicate the game end (block 174).

Figure 7:
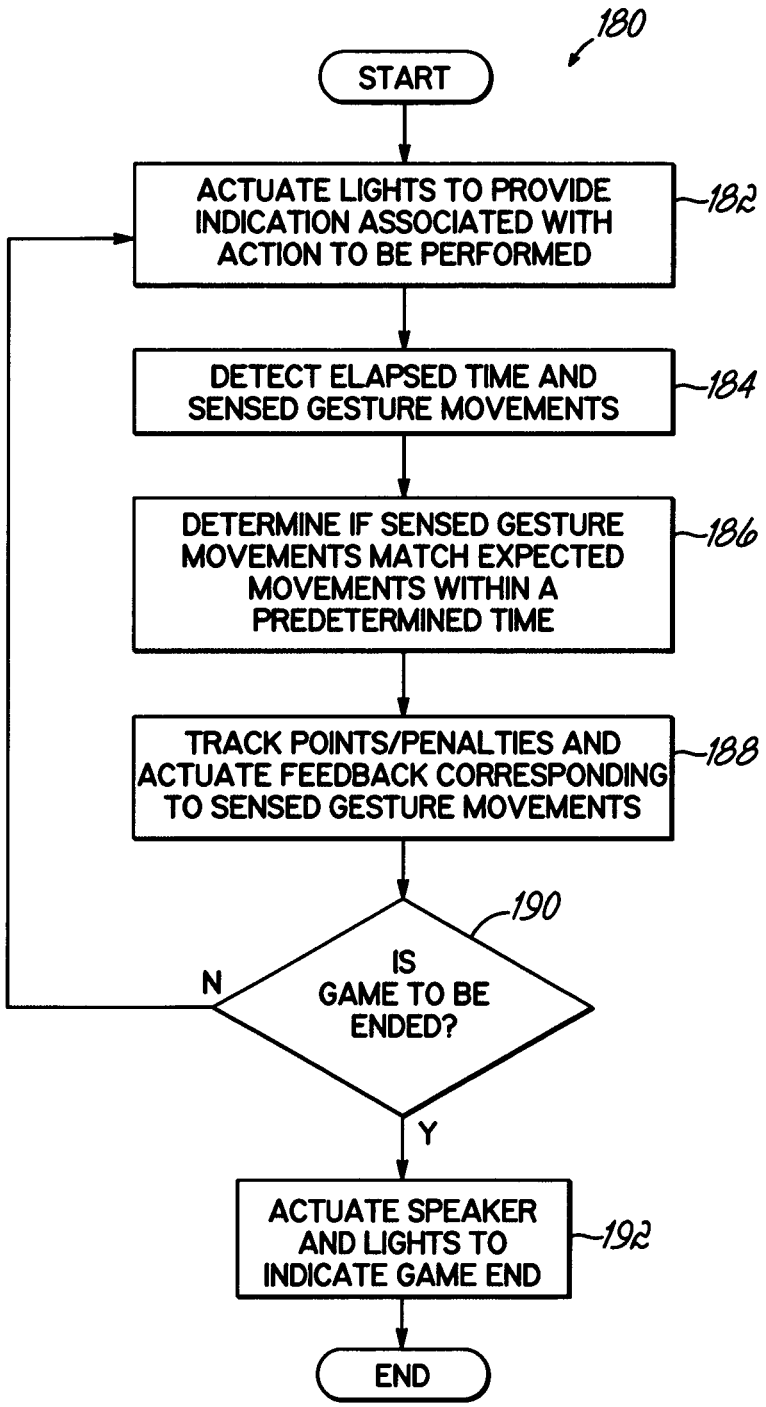
FIG. 7 is a flowchart showing a series of operations performed by the controller of the game device of FIG. 1 during a second type of game play experience.

A second game play experience may be entitled "follow the lights," which enables a different type of Simon-says game involving memorization of light association with gestures. FIG. 7 illustrates a corresponding series of operations 180 performed by the game device 10 during the second game play experience. As shown in that Figure, the controller 26 begins by actuating one or more of the LEDs 80 in combination to provide an indication associated with an action to be performed (block 182). In one example, the lighting of a blue LED 80 in combination with a red LED 80 may be associated with the gesture of waving the flag. The controller 26 then detects the time elapsed since the command and any sensed gesture movements detected by the sensors 24 (block 184). The controller 26 determines if any of the sensed gesture movements match the expected movements for the indicated action within a predetermined time (block 186). As noted above, the predetermined time is a threshold time for answering the prompt from the game device 10. Regardless of the outcome of the determination, the controller 26 then tracks any points or penalties to be applied to the player 110 and actuates feedback (such as via LEDs 80, speaker 82, and/or motor 84) corresponding to the sensed gesture movements (block 188). Therefore, if a flag waving gesture is detected, the speaker 82 may emit a sound of a flag waving in the wind. Similar to previous embodiments, the controller 26 then determines if the game is to be ended (block 190) such as for the collection of a threshold number of penalties. If the game is not to end, the controller 26 returns to block 182 to repeat the process of giving an indication. If the game is to be ended, then the controller 26 actuates the speaker 82 and/or the LEDs 80 to indicate the game end (block 192).

Figure 8:
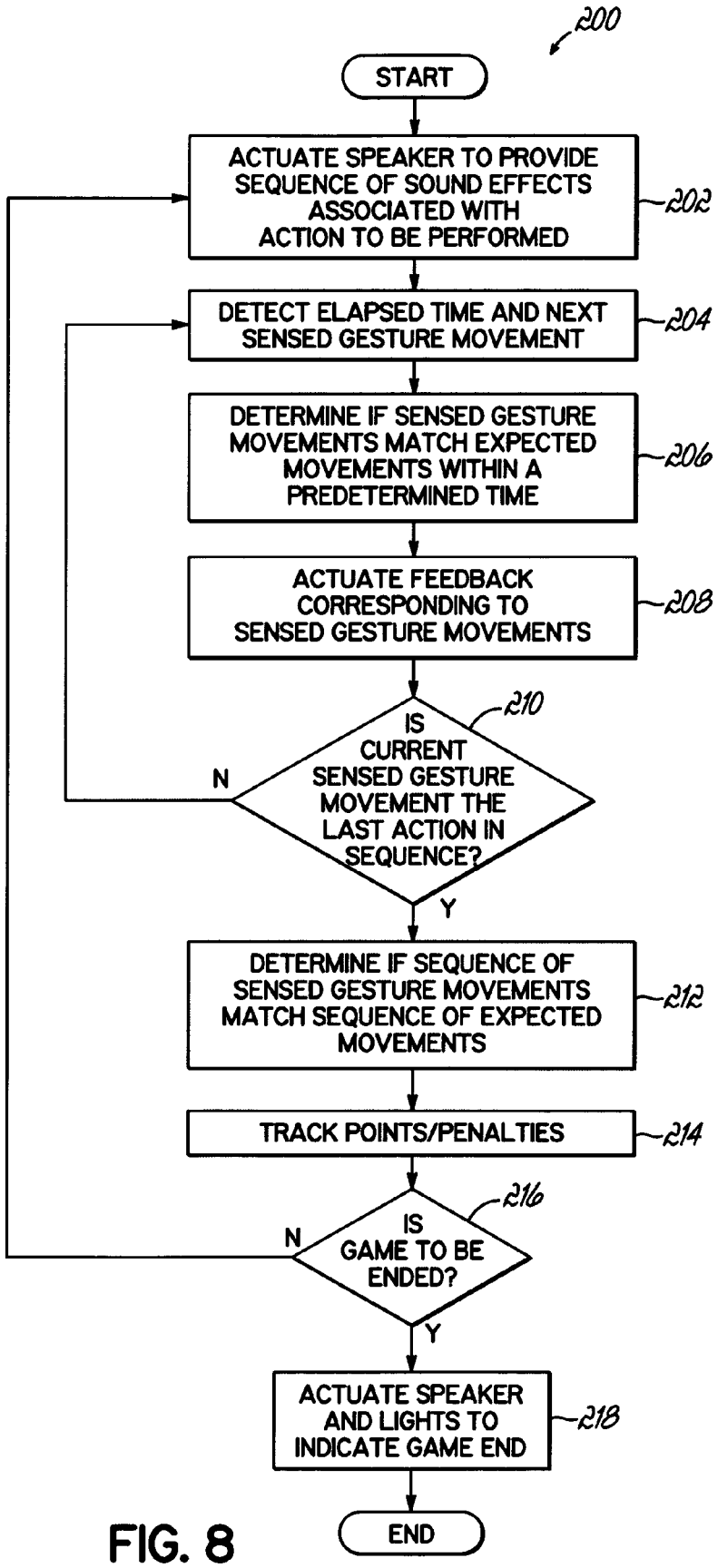
FIG. 8 is a flowchart showing a series of operations performed by the controller of the game device of FIG. 1 during a third type of game play experience.

A third game play experience may be entitled "remember the sounds," which enables a more complex and progressive type of game play. FIG. 8 illustrates a corresponding series of operations 200 performed by the game device 10 during the third game play experience. As shown in that Figure, the controller 26 begins by actuating the speaker 82 to provide a sequence of sound effects associated with a sequence of actions to be performed (block 202). For example, the speaker 82 may say "milk a cow, then flush a toilet, then open a jar." The controller 26 then detects the time elapsed since the command and any sensed gesture movements detected by the sensors 24 (block 204). The controller 26 determines whether the sensed gesture movements match the expected movements for the first indicated action within a predetermined time (block 206). As noted above, the predetermined time is a threshold time for answering the prompt from the game device 10. Regardless of the outcome of the determination, the controller 26 actuates feedback (such as via LEDs 80, speaker 82, and/or motor 84) corresponding to the sensed gesture movements (block 208). Therefore, if a toilet flushing gesture is detected, the speaker 82 may emit a sound of a flushing toilet. The controller 26 then determines if the currently sensed gesture movement was the last action in the sequence of actions to be performed (block 210). If the sensed gesture is not the last in the sequence, then the controller 26 returns to block 204 to continue detecting elapsed time and the next sensed gesture movements.

On the other hand, if the currently sensed gesture movement is the last action of the sequence, then the controller 26 proceeds to determine if the sequence of sensed gesture movements match the sequence of expected movements (block 212). The controller 26 tracks any points and penalties to be applied to the player based on this determination (block 214). Similar to previous embodiments, the controller 26 then determines if the game is to be ended (block 216), such as for the collection of a threshold number of penalties. If the game is not to end, the controller 26 returns to block 202 to repeat the process of generating sound effects. If the game is to be ended, then the controller 26 actuates the speaker 82 and/or the LEDs 80 to indicate the game end (block 218).

Figure 9:
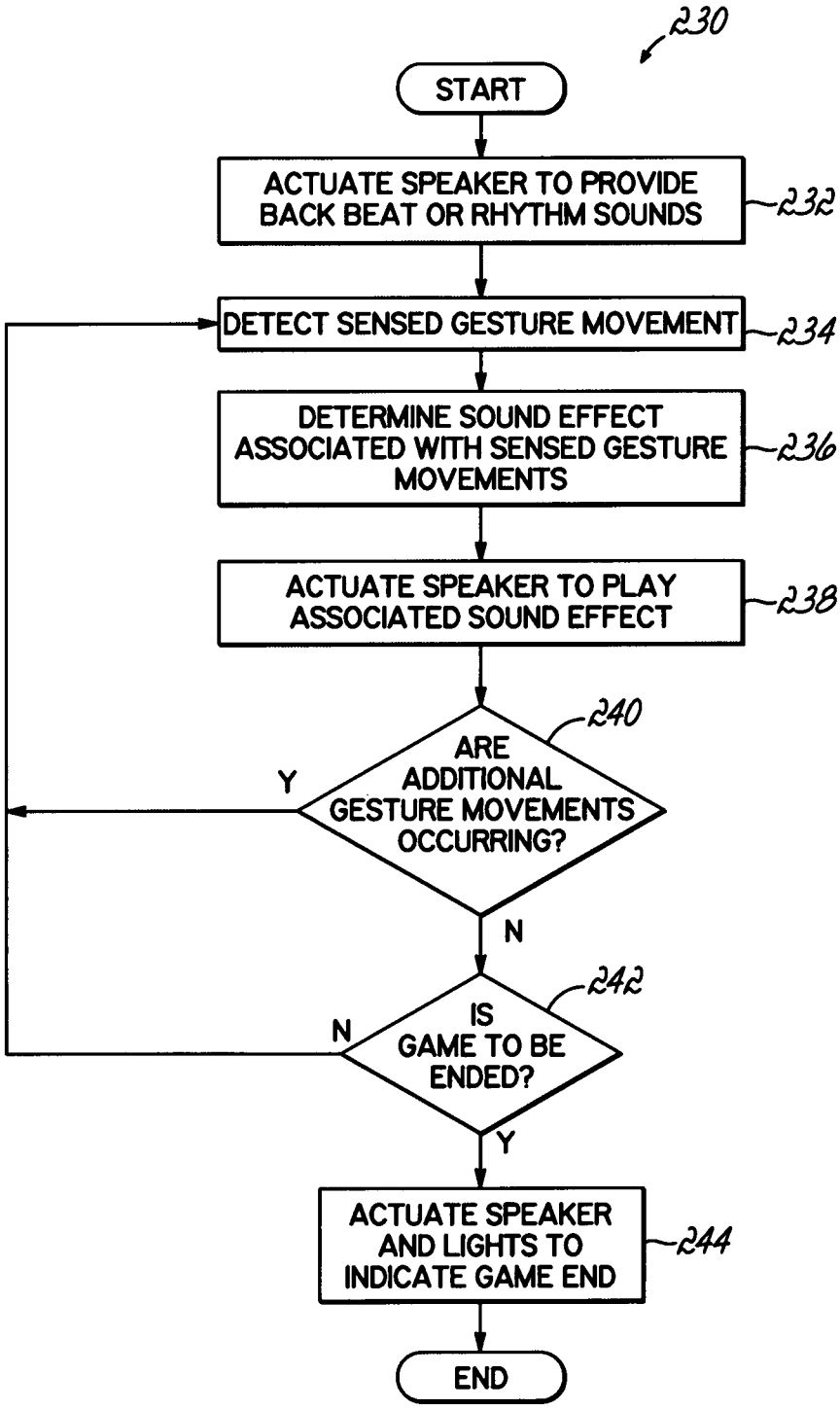
FIG. 9 is a flowchart showing a series of operations performed by the controller of the game device of FIG. 1 during a fourth type of game play experience.

A fourth game play experience may be entitled "freestyle sounds," which enables a type of freestyle music-making with the game device 10. FIG. 9 illustrates a corresponding series of operations 230 performed by the game device 10 during the fourth game play experience. As shown in that Figure, the controller 26 begins by actuating the speaker 82 to provide a back beat or rhythm sounds (block 232). The controller 26 then detects any sensed gesture movements detected by the sensors 24 (block 234). The controller 26 determines what sound effect is associated with the sensed gesture movement (block 236). The speaker 82 is then actuated to play that sound effect associated with the sensed gesture movement (block 238). The controller 26 determines if any additional gesture movements are occurring, which indicates more sound effects to be generated (block 240). If more gesture movements are occurring, then the controller 26 returns to block 234 to repeat the detection process. Similar to previous embodiments, the controller 26 then determines if the game is to be ended (block 242). If the game is not to end, the controller 26 returns to block 234 to repeat the detection of gestures process. If the game is to be ended, then the controller 26 actuates the speaker 82 and/or the LEDs 80 to indicate the game end (block 244).

Figure 10:
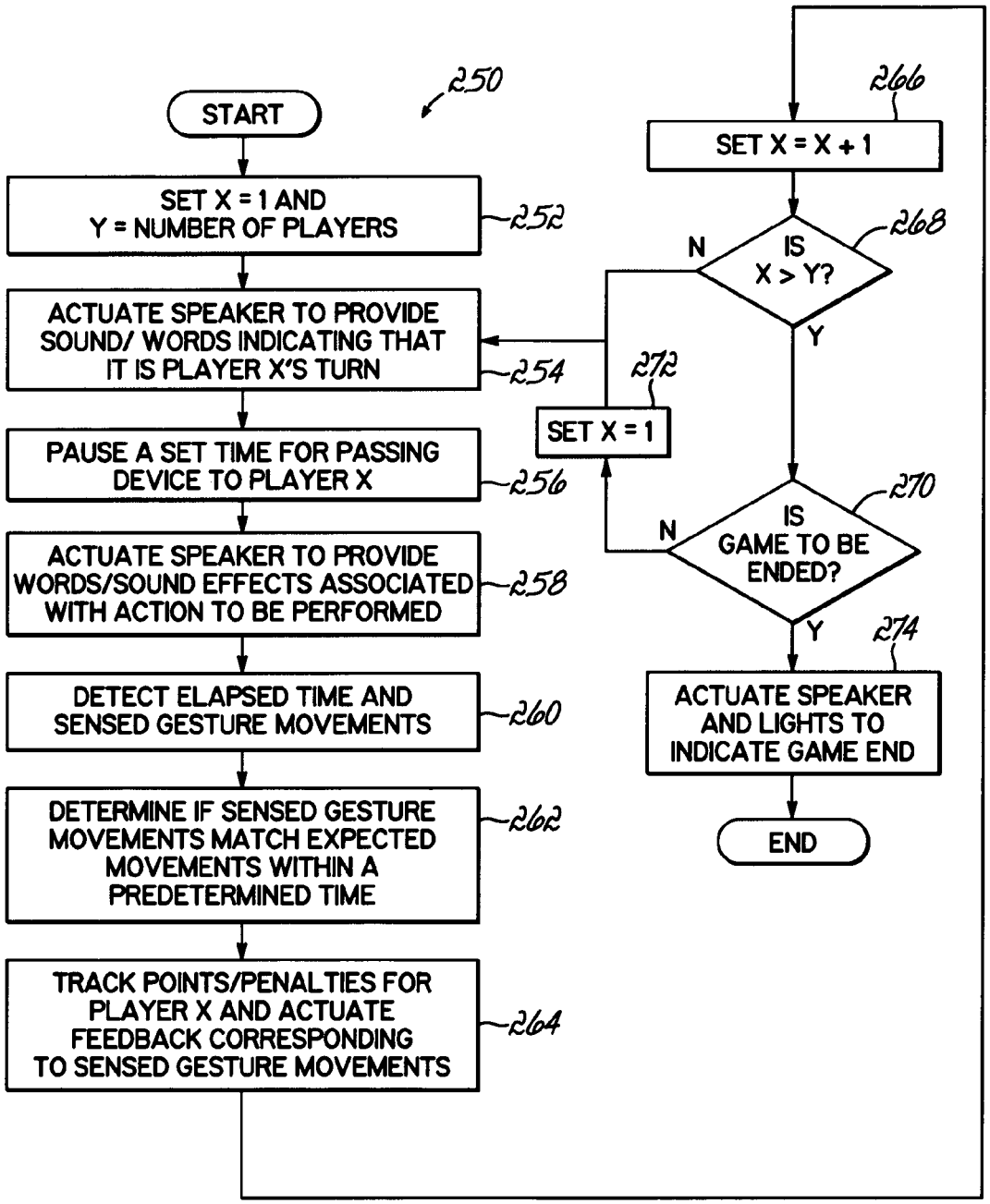
FIG. 10 is a flowchart showing a series of operations performed by the controller of the game device of FIG. 1 during a fifth type of game play experience.

A fifth game play experience may be entitled "multi-player follow the action," which enables any number of players 110 to experience the gesture response game play together. FIG. 10 illustrates a corresponding series of operations 250 performed by the game device 10 during the fifth game play experience. As shown in that Figure, the controller 26 begins by setting a variable X equal to 1 and another variable Y equal to the number of players 110 (block 252). The controller 26 then actuates the speaker 82 to provide sound or words that indicate that it is player X's turn (at the beginning, this will be player 1) (block 254). The controller 26 pauses for a set period of time such as two seconds to enable the game device 10 to be picked up or passed to the current player 110 (block 256). The controller 26 then actuates the speaker 82 to provide an indication in the form of words or a sound effect associated with an action to be performed (block 258). The controller 26 then detects the time elapsed since the command and any sensed gesture movements detected by the sensors 24 (block 260). The controller 26 determines if any of the sensed gesture movements match the expected movements for the indicated action within a predetermined time (block 262). As noted above, the predetermined time is a threshold time for answering the prompt from the game device 10. Regardless of the outcome of the determination, the controller 26 then tracks any points or penalties to be applied to player X and actuates feedback (such as via LEDs 80, speaker 82, and/or motor 84) corresponding to the sensed gesture movements (block 264).

The controller 26 then proceeds to increment the variable X by 1 (block 266). The controller 26 determines if the variable X is now greater than the value stored for Y, which would indicate that all players 110 have had a turn (block 268). If X is not greater than Y, the controller 26 returns to block 254 to repeat the step of actuating the speaker 82 to indicate the next player's turn. If X is greater than Y and every player 110 has had the same number of turns, then the controller 26 determines if the game is to be ended (block 270). If the game is not to end, the controller 26 resets X equal to 1 (block 272) and then returns to block 254 to repeat the step of actuating the speaker 82 to indicate the next player's turn. If the game is to be ended, then the controller 26 actuates the speaker 82 and/or the LEDs 80 to indicate the game end (block 274).

Figure 11:
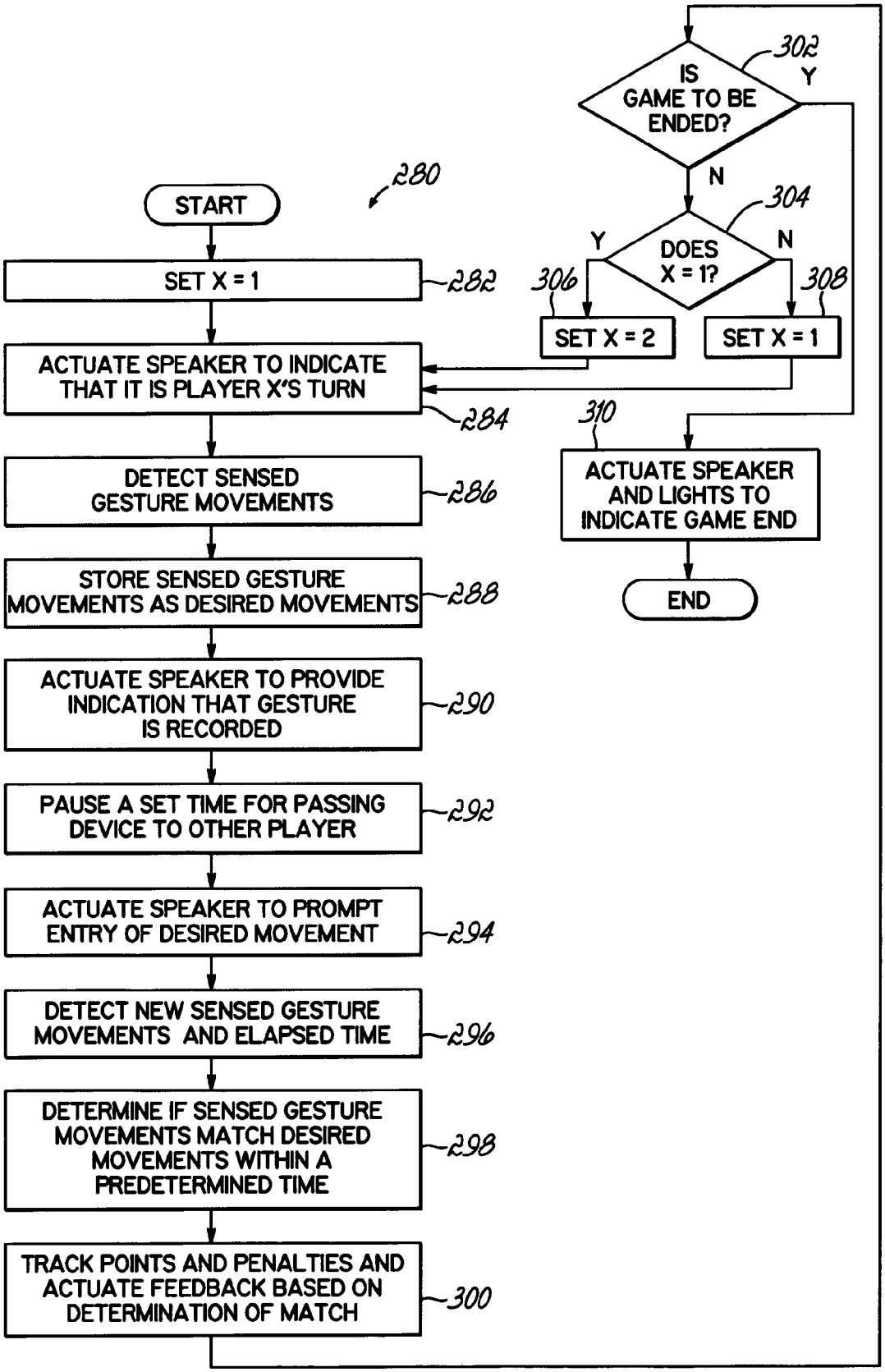
FIG. 11 is a flowchart showing a series of operations performed by the controller of the game device of FIG. 1 during a sixth type of game play experience.

A sixth game play experience may be entitled "two player repeat the action," which enables a follow-the-leader type of game play. FIG. 11 illustrates a corresponding series of operations 280 performed by the game device 10 during the sixth game play experience. As shown in that Figure, the controller 26 begins by setting a variable X equal to 1 (block 282) and by actuating the speaker 82 to indicate that it is player X's turn (block 284). This sequence initially provides an indication that the first player should take the first turn. The controller 26 receives detected sensed gesture movements from the sensors 24 (block 286) after the current player begins moving the game device 10. The controller 26 stores the sensed gesture movements as desired movements (block 288). The controller 26 then actuates the speaker 82 to provide an indication that the gesture is recorded (block 290), such as by an approval sound, and then the game device 10 pauses for a set time to allow the current player to pass the game device 10 to the other player (block 292). The controller 26 actuates the speaker 82 to prompt entry of the desired movement from the other player (block 294). As with the other types of game play experiences, the controller 26 detects the new sensed gesture movements and an elapsed time (bock 296) and then determines whether the sensed gesture movements match the desired movements within a predetermined time (block 298). As noted above, the predetermined time is a threshold time for answering the prompt from the game device 10. Regardless of the outcome of the determination, the controller 26 tracks points and penalties that are applied to the players 110 and actuates feedback (such as via LEDs 80, speaker 82, and/or motor 84) based on whether a match was determined (block 300). Therefore, if the other player successfully repeats the gestures of the first player, the other player will earn a point.

Similar to previous embodiments, the controller 26 then determines if the game is to be ended (block 302) such as for the collection of a threshold number of penalties. If the game is not to end, the controller 26 determines whether X is equal to 1 (block 304) to determine if the first player just had a turn. If so, then the controller 26 sets X equal to 2 (block 306), but if not, the controller sets X equal to 1 (block 308) (thereby ensuring alternated game play). In either case, the controller 26 then returns to block 284 to indicate which player's turn it is to set the desired action. If the game is to be ended, then the controller 26 actuates the speaker 82 and/or the LEDs 80 to indicate the game end (block 310). It will be understood that another variable could be kept and a higher number of actions or gestures could be required for each round, thereby increasing the difficulty of repeating the gestures as the game play experience progresses.

Figure 12:
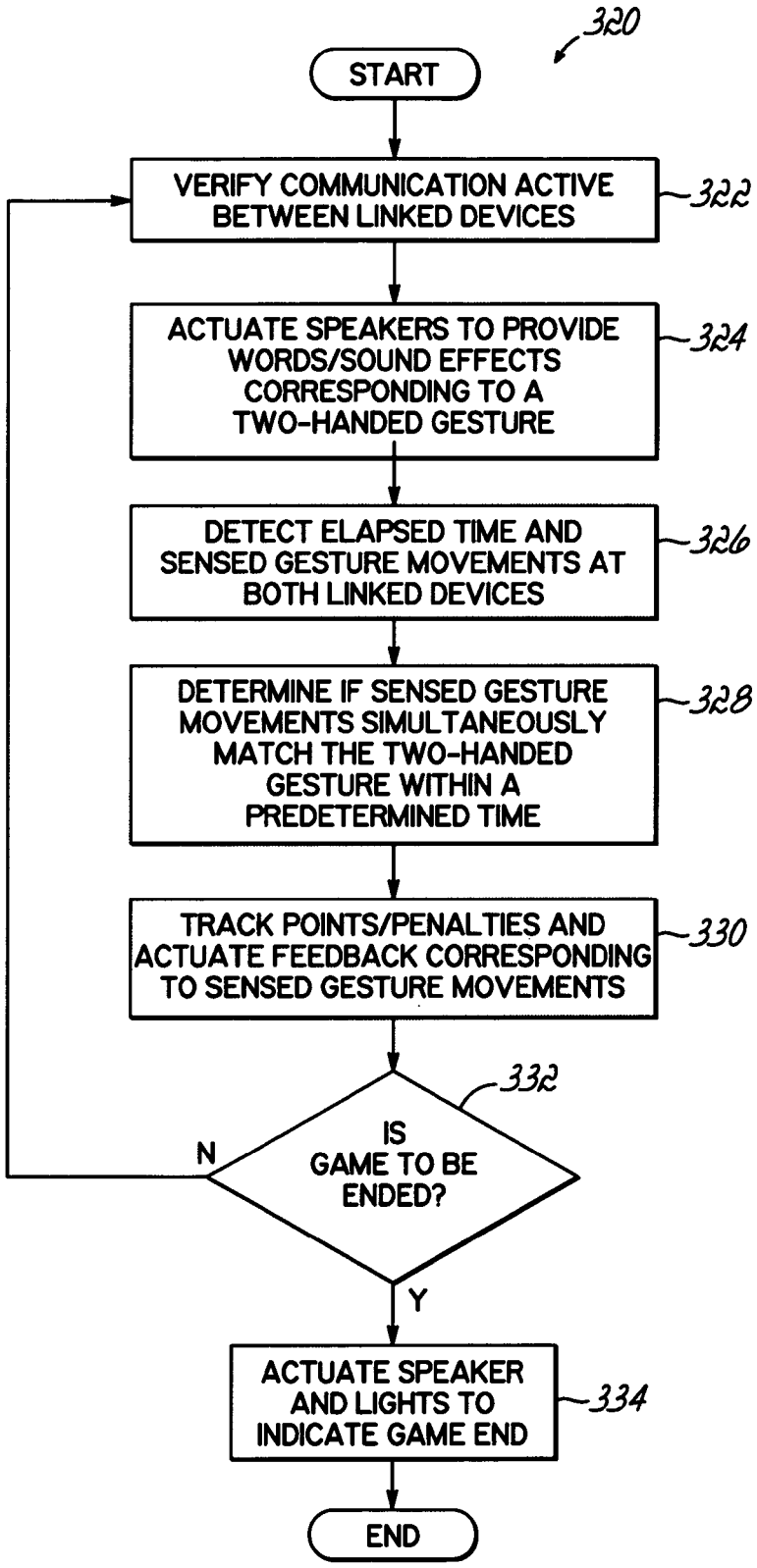
FIG. 12 is a flowchart showing a series of operations performed by the controller of the game device of FIG. 1 during a seventh type of game play experience.

A seventh game play experience may be entitled "two-handed follow the action/sound," which enables more complex gestures to be used during game play. FIG. 12 illustrates a corresponding series of operations 320 performed by the game device 10 during the seventh game play experience. As shown in that Figure, the controller 26 begins by verifying that communication is active and working between two linked devices 10 (block 322). The game devices 10 may be linked in various ways, including via the communication device 94 described above. The controller 26 then actuates the speaker 82 to provide words or sound effects associated with a two-handed action to be performed (block 324). For example, the speaker 82 may say "flap wings" or "boxing match." The controller 26 then detects the time elapsed since the command and any sensed gesture movements detected by the sensors 24 at both linked game devices 10 (block 326). The controller 26 determines whether the sensed gesture movements match the expected movements for the indicated two-handed action within a predetermined time (block 328). As noted above, the predetermined time is a threshold time for answering the prompt from the game device 10. Regardless of the outcome of the determination, the controller 26 tracks points and penalties to be applied to the player 110 and actuates feedback (such as via LEDs 80, speaker 82, and/or motor 84) corresponding to the sensed gesture movements (block 330). Similar to previous embodiments, the controller 26 then determines if the game is to be ended (block 332) such as for the collection of a threshold number of penalties. If the game is not to end, the controller 26 returns to block 322 to repeat the verification process. If the game is to be ended, then the controller 26 actuates the speaker 82 and/or the LEDs 80 to indicate the game end (block 334). It will be appreciated that this game play experience may be combined with the one handed gesture commands and responses to further diversify the game play.

Figure 13:
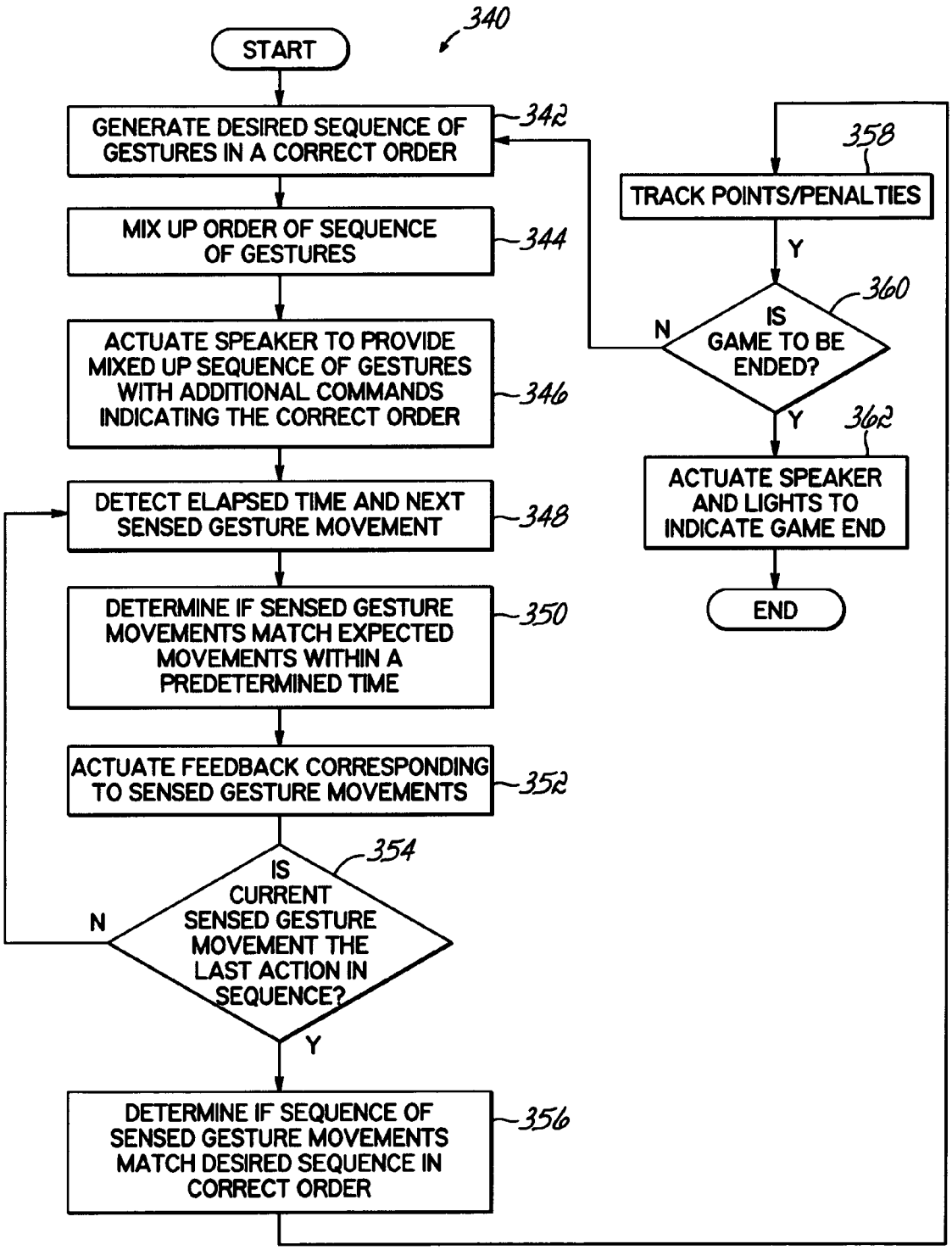
FIG. 13 is a flowchart showing a series of operations performed by the controller of the game device of FIG. 1 during a eighth type of game play experience.

An eighth game play experience may be entitled "phrase sequence," which enables an even more complex and progressive type of game play including some word play. FIG. 13 illustrates a corresponding series of operations 340 performed by the game device 10 during the eighth game play experience. As shown in that Figure, the controller 26 begins by generating a desired sequence of gestures in a correct order (block 342). The controller 26 then mixes up the order of the sequence of gestures (block 344), and actuates the speaker 82 to provide a mixed up sequence of sound effects associated with the sequence of actions, as well as additional commands to indicate the corrected order (block 346). For example, the speaker 82 may say "pump a tire after you rev the motorcycle, but first, pour a drink." In another example, the game device 10 could command "scratch your back before you eat corn, then steer the car." The controller 26 then detects the time elapsed since the command and any sensed gesture movements detected by the sensors 24 (block 348). The controller 26 determines whether the sensed gesture movements match the expected movements for the first indicated action within a predetermined time (block 350). As noted above, the predetermined time is a threshold time for answering the prompt from the game device 10. Regardless of the outcome of the determination, the controller 26 actuates feedback (such as via LEDs 80, speaker 82, and/or motor 84) corresponding to the sensed gesture movements (block 352). The controller 26 then determines if the currently sensed gesture movement was the last action in the sequence of actions to be performed (block 354). If the sensed gesture is not the last in the sequence, then the controller 26 returns to block 348 to continue detecting elapsed time and the next sensed gesture movements.

On the other hand, if the currently sensed gesture movement is the last action of the sequence, then the controller 26 proceeds to determine if the sequence of sensed gesture movements match the sequence of expected movements (block 356). The controller 26 tracks any points and penalties to be applied to the player 110 based on this determination (block 358). Similar to previous embodiments, the controller 26 then determines if the game is to be ended (block 360), such as for the collection of a threshold number of penalties.

If the game is not to end, the controller 26 returns to block 342 to repeat the sequence generation. If the game is to be ended, then the controller 26 actuates the speaker 82 and/or the LEDs 80 to indicate the game end (block 362).

Figure 14:
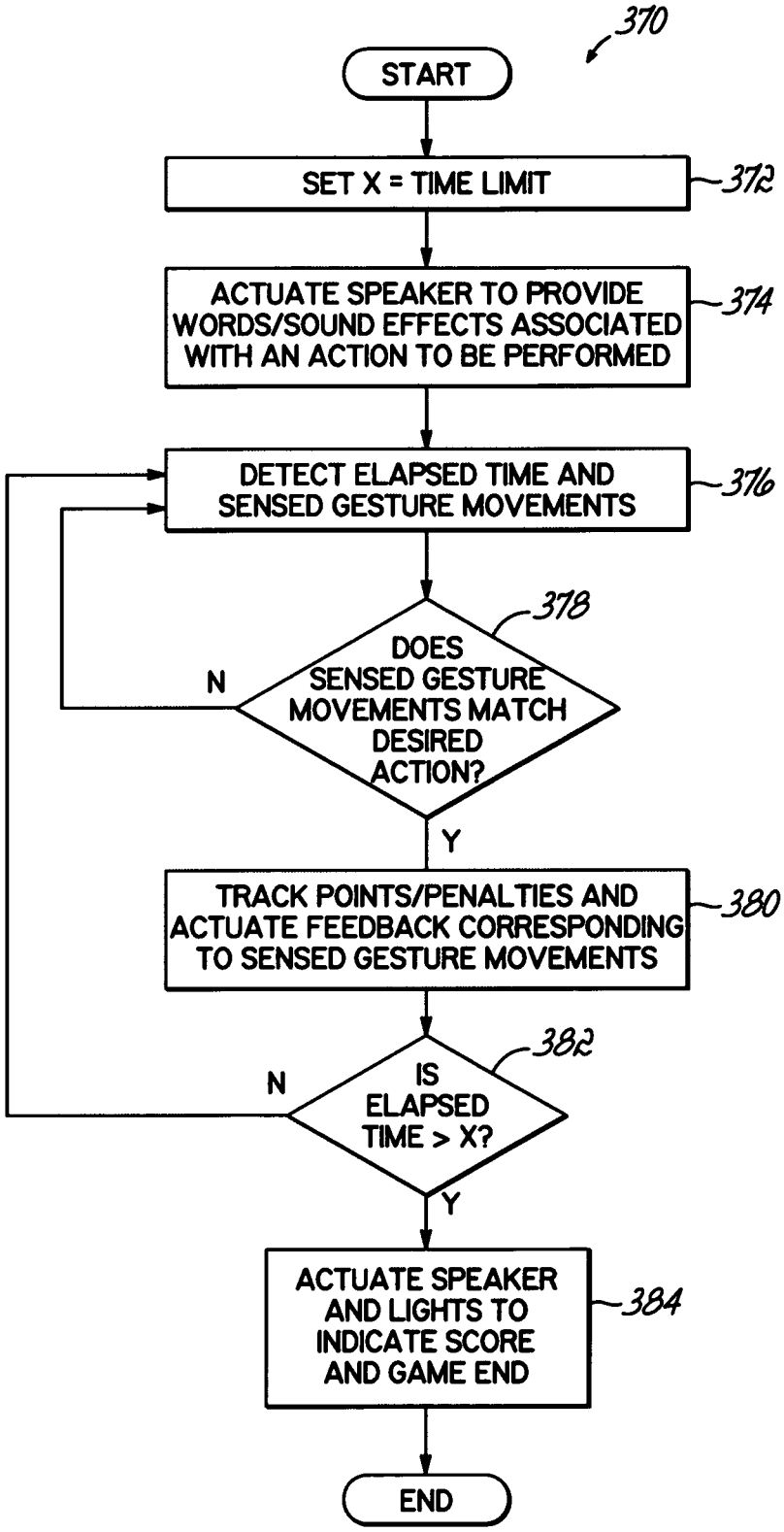
FIG. 14 is a flowchart showing a series of operations performed by the controller of the game device of FIG. 1 during a ninth type of game play experience.

A ninth game play experience may be entitled "reactions," which enables a competitive high scoring type of game play. FIG. 14 illustrates a corresponding series of operations 370 performed by the game device 10 during the ninth game play experience. As shown in that Figure, the controller 26 begins by setting a variable X equal to a time limit such as 30 seconds (block 372). The controller also actuates the speaker 82 to provide an indication associated with an action to be performed (block 374). For example, the speaker 82 may tell the player 110 to swat all the flies. The controller 26 then detects the time elapsed since the command and any sensed gesture movements detected by the sensors 24 (block 376). The controller 26 determines if any of the sensed gesture movements match the expected movements for the indicated action (block 378). If the sensed gesture movements do not match the desired action, such as when the player 110 is performing an incorrect gesture, the controller 26 returns to block 376 to continue sensing gesture movements and to continue detecting the elapsed time. If the sensed gesture movements do match the desired action, the controller 26 then tracks any points or penalties to be applied to the player 110 and actuates feedback (such as via LEDs 80, speaker 82, and/or motor 84) corresponding to the sensed gesture movements (block 380). Therefore, if a fly swatting gesture is detected, the speaker 82 may emit a sound of a fly swatter hitting a target. The controller 26 determines if the elapsed time is greater than X (block 382), which would indicate the end of the time limit. If the time limit has not been reached, then the controller 26 returns to block 376 to continue sensing gesture movements and to continue detecting the elapsed time. If the time limit has been exceeded, then the controller 26 actuates the speaker 82 and/or the LEDs 80 to indicate the score achieved and the game end (block 384).

Figure 15:
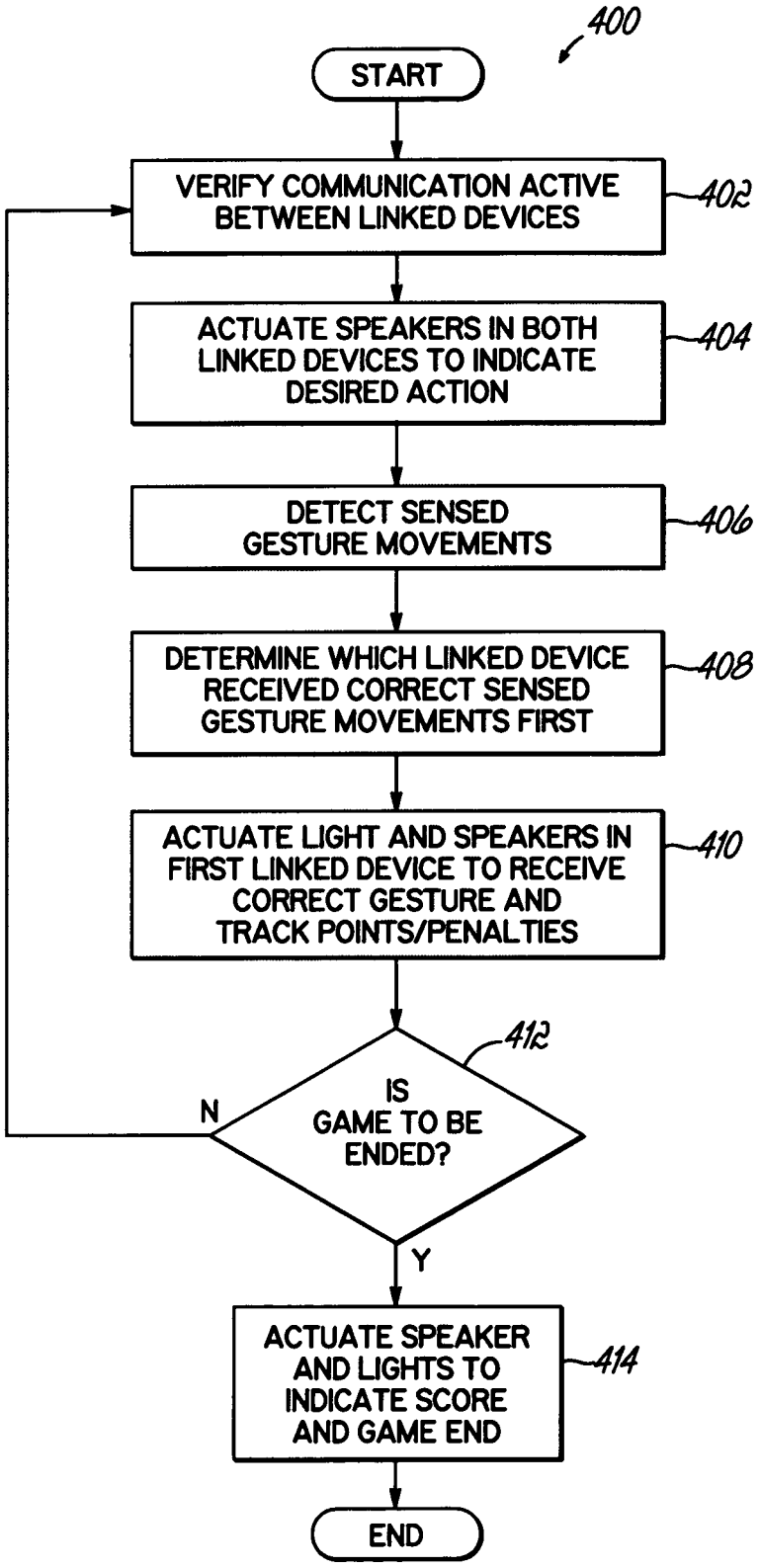
FIG. 15 is a flowchart showing a series of operations performed by the controller of the game device of FIG. 1 during a tenth type of game play experience.

A tenth game play experience may be entitled "two-player race," which enables a competitive reaction race style of gesture-based game play. FIG. 15 illustrates a corresponding series of operations 400 performed by the game device 10 during the tenth game play experience. As shown in that Figure, the controller 26 begins by verifying that communication is active between two linked game devices 10 (block 402). The controllers 26 then actuate the speakers 82 in both linked devices 10 to simultaneously provide an indication associated with an action to be performed (block 404). The controller 26 of each game device 10 then detects any sensed gesture movements detected by the sensors 24 (block 406). The controllers 26 collectively determine which linked device 10 received the correct sensed gesture movements first in time (block 408). The controller 26 of the first game device 10 to receive a correct input then actuates the LEDs 80 and speaker 82 to indicate the first correct gesture, while all controllers 26 track points and penalties for the players 110 (block 410). Similar to previous embodiments, the controllers 26 then determine if the game is to be ended (block 412). If the game is not to end, the controllers 26 return to block 402 to repeat the verification. If the game is to be ended, then the controller 26 actuates the speaker 82 and/or the LEDs 80 to indicate the player scores and the game end (block 414). It will be understood that more than two game devices 10 may also be linked to provide the tenth game play experience for more than two players 110 simultaneously in other embodiments.

As described above, the various game play experiences enabled by the game device 10 provide simple and challenging game experiences that can be changed each time. As a result, the gesture-based game play is easy to learn, but nearly impossible to master fully for most players 110. With the game device 10 being self-contained, the game device 10 does not rely on other equipment or hardware to be present and working properly to enjoy the various game play experiences. Thus, the game device 10 and associated methods provide nuanced gesture-based games in a package that can easily travel or be played "on-the-go." Despite the existence of many other types of games, none of the known conventional game devices enable gesture-based game play in a self-contained package. Therefore, the current invention achieves advantages not seen before in the game device art.

While the present invention has been illustrated by the description of specific embodiments thereof, and while these embodiments have been described in considerable detail, they are not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A method of operating a self-contained electronic handheld gesture game device during a game play experience, the game device being self-contained by including only a single housing without requiring power cords or any modules that require communication with external hardware and display screens during the game play experience, the housing defining a handle and an interior space containing at least one sensor and a controller including a processor, the method comprising:

generating at least one of an audible or a visual prompt, with at least one of lights or a speaker located within the interior space of the single housing, for a player to perform at least one desired three-dimensional gesture movement with the self-contained game device for at least a part of the game play experience;

sensing player-performed three-dimensional gesture movements of the single housing of the game device with the at least one sensor, wherein the at least one sensor is configured to sense only three-dimensional movements of an entirety of the single housing and is not configured to sense physical touching or manipulation of a switch or button during any of the game play experience;

determining with the processor if the sensed player-performed three-dimensional gesture movements correspond to the at least one desired three-dimensional gesture movement, the at least one desired three-dimensional gesture movement being predetermined and stored in the controller; and generating at least one of audible, visual, or tactile feedback with the self-contained game device when the sensed player-performed three-dimensional gesture movements correspond to the at least one desired three-dimensional gesture movement;

wherein, the at least one sensor is operative to detect and identify any three-dimensional and rotational movements of the entirety of the single housing such that the game device prompts for and detects only three-dimensional gesture movements of the single housing during the game play experience without requiring or sensing for physical manipulation of a switch or button by the player during the game play experience, such that no player input by physical manipulation of a switch or button is used during the game play experience.

2. The method of claim 1, wherein the game play experience further comprises:

actuating the speaker to generate the audible prompt associated with the at least one desired three-dimensional gesture movement to be performed by the player;

detecting elapsed time while sensing the player-performed three-dimensional gesture movements of the game device;

determining whether the sensed player-performed three-dimensional movements match the at least one desired three-dimensional gesture movement within a predetermined time limit;

tracking points or penalties applied to the player depending on whether the sensed player-performed three-dimensional gesture movements matched the at least one desired three-dimensional gesture movement; and actuating at least one of the lights or the speaker to provide feedback to the player on whether a correct three-dimensional gesture movement was performed.

3. The method of claim 2, wherein actuating the speaker to generate the audible prompt includes generating at least one of words describing the at least one desired three-dimensional gesture movement and sound effects associated with the at least one desired three-dimensional gesture movement.

4. The method of claim 1, wherein the game play experience further comprises:

actuating the lights to generate the visual prompt associated with the at least one desired three-dimensional gesture movement to be performed by the player;

detecting elapsed time while sensing the player-performed three-dimensional gesture movements of the game device;

determining whether the sensed player-performed three-dimensional gesture movements match the at least one desired three-dimensional gesture movement within a predetermined time limit;

tracking points or penalties applied to the player depending on whether the sensed player-performed three-dimensional gesture movements matched the at least one desired three-dimensional gesture movement; and actuating the lights and/or the speaker to provide feedback to the player on whether a correct gesture movement was performed.

5. The method of claim 1, wherein the game play experience further comprises:

(a) actuating a speaker to generate a sequence of audible prompts associated with a sequence of the at least one desired three-dimensional gesture movement to be performed by the player;

(b) detecting elapsed time while sensing the player-performed three-dimensional gesture movements of the game device;

(c) determining whether the sensed player-performed three-dimensional gesture movements match the at least one desired three-dimensional gesture movement within a predetermined time limit;

(d) actuating the speaker to provide feedback to the player when the at least one desired three-dimensional gesture movement has been detected;

(e) repeating steps (b), (c), and (d) until a last sensed player-performed three-dimensional gesture movement is performed; and (f) tracking points or penalties applied to the player depending on whether a sequence of the sensed player-performed three-dimensional gesture movements matched the sequence of the at least one desired three-dimensional gesture movement.

6. The method of claim 1, wherein the game play experience further comprises:

actuating the speaker to generate a back beat or rhythm sounds, which prompt the player to perform the at least one desired three-dimensional gesture movement;

sensing the player-performed three-dimensional gesture movements of the game device;

determining whether the sensed player-performed three-dimensional gesture movements match the at least one desired three-dimensional gesture movement; and actuating the speaker to play a sound effect associated with the at least one desired three-dimensional gesture movement when the sensed player-performed three-dimensional gesture movements match the at least one desired three-dimensional gesture movement.

7. The method of claim 1, wherein the game play experience further comprises:

(a) determining a current player from a known number of players;

(b) actuating a speaker to generate an audible prompt for the current player to pick up the game device;

(c) actuating the speaker to generate the audible prompt associated with the at least one desired three-dimensional gesture movement to be performed by the current player;

(d) detecting elapsed time while sensing the player-performed three-dimensional gesture movements of the game device;

(e) determining whether the sensed player-performed three-dimensional movements match the at least one desired three-dimensional gesture movement within a predetermined time limit;

(f) actuating the lights and/or the speaker to provide feedback to the current player on whether a correct gesture movement was performed; and (g) repeating steps (a) through (f) until each player in the known number of players has been the current player.

8. The method of claim 1, wherein the game play experience further comprises:

selecting a current player from first and second players;

actuating a speaker to generate an audible prompt for the current player to pick up the game device;

sensing the player-performed three-dimensional gesture movements of the game device performed by the current player;

storing the sensed player-performed three-dimensional gesture movements as a player-desired gesture movement;

actuating the speaker to provide an indication that the sensed player-performed three-dimensional gesture movements have been recorded and that the other player from the first and second players should pick up the game device;

actuating a speaker to generate an audible prompt for the other player to perform the player-desired gesture movement;

detecting elapsed time while sensing new player-performed three-dimensional gesture movements of the game device;

determining whether the new sensed player-performed three-dimensional gesture movements match the player-desired gesture movement within a predetermined time limit; and actuating the lights and/or the speaker to provide feedback to the other player on whether a correct gesture movement was performed.

9. The method of claim 1, wherein the game play experience further comprises:

(a) generating a sequence of the at least one desired three-dimensional gesture movement in a correct order;

(b) mixing up the correct order of the sequence;

(c) actuating the speaker to generate a sequence of audible prompts associated with the mixed up correct order of the sequence to be performed by the player, and also to generate additional audible commands indicating the correct order;

(d) detecting elapsed time while sensing the player-performed three-dimensional gesture movements of the game device;

(e) determining whether the sensed player-performed three-dimensional gesture movements match the at least one desired three-dimensional gesture movement within a predetermined time limit;

(f) actuating the speaker to provide feedback to the player when the at least one desired three-dimensional gesture movement has been detected;

(g) repeating steps (d), (e), and (f) until a last sensed player-performed three-dimensional gesture movement is performed; and (h) tracking points or penalties applied to the player depending on whether a sequence of the sensed player-performed three-dimensional gesture movements matched the sequence of the at least one desired three-dimensional gesture movement in the correct order.

10. The method of claim 1, wherein the game play experience further comprises:

(a) setting a time limit;

(b) actuating the speaker to generate the audible prompt associated with the at least one desired three-dimensional gesture movement to be performed by the player;

(c) detecting elapsed time while sensing the player-performed three-dimensional gesture movements of the game device;

(d) determining whether the sensed player-performed three-dimensional gesture movements match the at least one desired three-dimensional gesture movement;

(e) tracking points or penalties applied to the player depending on whether the sensed player-performed three-dimensional movements matched the at least one desired three-dimensional gesture movement; and (f) actuating the lights and/or the speaker to provide feedback to the player on whether a correct gesture movement was performed;

(g) repeating steps (c) through (f) until the elapsed time exceeds the time limit; and (h) actuating the lights and/or the speaker to indicate a score achieved by the player and end the game.

11. An electronic handheld gesture game device configured to perform operations defining a game play experience, the game device comprising:

a single housing including a handle and an interior space;

at least one sensor located in the interior space and configured to detect three-dimensional movements of the housing, wherein the at least one sensor is configured to sense only three-dimensional movements of an entirety of the single housing and is not configured to sense physical touching or manipulation of a switch or button during any of the game play experience;

a speaker located in the interior space and configured to generate audible prompts and feedback for a player holding the housing;

lights located in the interior space and configured to generate visual prompts and feedback for the player; and a controller located in the interior space and operatively coupled to the sensor and the speaker, the controller including a processor performing a series of operations including actuating the speaker to provide a prompt for the player to perform at least one desired three-dimensional gesture movement, determining whether sensed player-performed three-dimensional gesture movements of the housing correspond to the at least one desired three-dimensional gesture movement stored in the controller, and actuating the speaker to provide feedback when the sensed player-performed three-dimensional gesture movements correspond to the at least one desired three-dimensional gesture movement stored in the controller, wherein the game device is self-contained by including only the single housing with components within the single housing and without requiring power cords or any modules that require communication with external hardware and display screens during game play, and the at least one sensor operative to detect and identify any three-dimensional and rotational movements of the entirety of the single housing such that the game device prompts for and detects only three-dimensional gesture movements of the single housing during the game play experience without requiring or sensing for physical manipulation of a switch or button by the player during the game play experience, such that no player input by physical manipulation of a switch or button is used in the game play experience.

12. The handheld gesture game device of claim 11, further comprising:

a motor located within the interior space and configured to generate tactile feedback at the handle for the player.

13. The handheld gesture game device of claim 11, wherein the at least one sensor includes at least one of a rotation detecting switch, a ball switch, a gravity switch, a tilt switch, and an accelerometer.

14. The handheld gesture game device of claim 11, wherein the controller is operable to perform a series of operations defining the game play experience, the series of operations comprising:

actuating the speaker to generate the audible prompt associated with the at least one desired three-dimensional gesture movement to be performed by the player;

detecting elapsed time while sensing player-performed three-dimensional gesture movements of the game device;

determining whether the sensed player-performed three-dimensional gesture movements match the at least one desired three-dimensional gesture movement within a predetermined time limit;

tracking points or penalties applied to the player depending on whether the sensed player-performed three-dimensional gesture movements matched the at least one desired three-dimensional gesture movement; and actuating the speaker to provide feedback to the player on whether a correct three-dimensional gesture movement was performed.

15. The handheld gesture game device of claim 11, wherein the controller is operable to perform a series of operations defining the game play experience, the series of operations comprising:

actuating the lights to generate the visual prompt associated with the at least one desired gesture movement to be performed by the player;

detecting elapsed time while sensing the player-performed three-dimensional gesture movements of the game device;

determining whether the sensed player-performed three-dimensional gesture movements match the at least one desired three-dimensional gesture movement within a predetermined time limit;

tracking points or penalties applied to the player depending on whether the sensed player-performed three-dimensional gesture movements matched the at least one desired three-dimensional gesture movement; and actuating the lights and/or the speaker to provide feedback to the player on whether a correct gesture movement was performed.

16. The handheld gesture game device of claim 11, wherein the controller is operable to perform a series of operations defining the game play experience, the series of operations comprising:

(a) actuating the speaker to generate a sequence of audible prompts associated with a sequence of the at least one desired three-dimensional gesture movement to be performed by the player;

(b) detecting elapsed time while sensing the player-performed three-dimensional movements of the game device;

(c) determining whether the sensed player-performed three-dimensional movements match the at least one desired three-dimensional gesture movement within a predetermined time limit;

(d) actuating the speaker to provide feedback to the player when the at least one desired three-dimensional gesture movement has been detected;

(e) repeating steps (b), (c), and (d) until a last sensed player-performed three-dimensional movement of the sequence is performed; and (f) tracking points or penalties applied to the player depending on whether a sequence of sensed player-performed three-dimensional gesture movements matched the sequence of the at least one desired three-dimensional gesture movement.

17. The handheld gesture game device of claim 11, wherein the controller is operable to perform a series of operations defining the game play experience, the series of operations comprising:

actuating the speaker to generate a back beat or rhythm sounds, which prompt the player to perform the at least one desired three-dimensional gesture movement;

sensing the player-performed three-dimensional movements of the game device;

determining whether the sensed player-performed three-dimensional movements match at least one desired three-dimensional gesture movement; and actuating the speaker to play a sound effect associated with the at least one desired three-dimensional gesture movement when the sensed player-performed three-dimensional gesture movements match the at least one desired three-dimensional gesture movement.

18. The handheld gesture game device of claim 11, wherein the controller is operable to perform a series of operations defining the game play experience, the series of operations comprising:

(a) determining a current player from a known number of players;

(b) actuating the speaker to generate an audible prompt for the current player to pick up the game device;

(c) actuating the speaker to generate the audible prompt associated with the at least one desired three-dimensional gesture movement to be performed by the current player;

(d) detecting elapsed time while sensing the player-performed three-dimensional gesture movements of the game device;

(e) determining whether the sensed player-performed three-dimensional gesture movements match the at least one desired three-dimensional gesture movement within a predetermined time limit;

(f) actuating the lights and/or the speaker to provide feedback to the current player on whether a correct gesture movement was performed; and (g) repeating steps (a) through (f) until each player in the known number of players has been the current player.

19. The handheld gesture game device of claim 11, wherein the controller is operable to perform a series of operations defining the game play experience, the series of operations comprising:

selecting a current player from first and second players;

actuating the speaker to generate an audible prompt for the current player to pick up the game device;

sensing the player-performed three-dimensional gesture movements of the game device performed by the current player;

storing the sensed movements as a player-desired gesture movement;

actuating the speaker to provide an indication that the sensed player-performed three-dimensional gesture movements have been recorded and that the other player from the first and second players should pick up the game device;

actuating a speaker to generate an audible prompt for the other player to perform the player-desired gesture movement;

detecting elapsed time while sensing new player-performed three-dimensional gesture movements of the game device;

determining whether the new sensed player-performed three-dimensional gesture movements match the player-desired gesture movement within a predetermined time limit; and actuating the lights and/or the speaker to provide feedback to the other player on whether a correct gesture movement was performed.

20. The handheld gesture game device of claim 11, wherein the controller is operable to perform a series of operations defining the game play experience, the series of operations comprising:

(a) generating a sequence of the at least one desired three-dimensional gesture movement in a correct order;

(b) mixing up the correct order of the sequence of the at least one desired three-dimensional gesture movement;

(c) actuating the speaker to generate a sequence of audible prompts associated with the mixed up correct order of the sequence of at least one desired three-dimensional gesture movement to be performed by the player, and also to generate additional audible commands indicating the correct order;

(d) detecting elapsed time while sensing the player-performed three-dimensional gesture movements of the game device;

(e) determining whether the sensed player-performed three-dimensional gesture movements match at least one desired three-dimensional gesture movement within a predetermined time limit;

(f) actuating the speaker to provide feedback to the player when the at least one desired three-dimensional gesture movement has been detected;

(g) repeating steps (d), (e), and (f) until a last sensed player-performed three-dimensional gesture movement is performed; and (h) tracking points or penalties applied to the player depending on whether a sequence of the sensed player-performed three-dimensional gesture movements matched the sequence of the at least one desired three-dimensional gesture movement in the correct order.

21. The handheld gesture game device of claim 11, wherein the controller is operable to perform a series of operations defining the game play experience, the series of operations comprising:

(a) setting a time limit;

(b) actuating the speaker to generate the audible prompt associated with the at least one desired three-dimensional gesture movement to be performed by the player;

(c) detecting elapsed time while sensing the player-performed three-dimensional gesture movements of the game device;

(d) determining whether the sensed player-performed three-dimensional gesture movements match the at least one desired three-dimensional gesture movement;

(e) tracking points or penalties applied to the player depending on whether the sensed player-performed three-dimensional movements matched the at least one desired three-dimensional gesture movement; and (f) actuating the lights and/or the speaker to provide feedback to the player on whether a correct gesture movement was performed;

(g) repeating steps (c) through (f) until the elapsed time exceeds the time limit; and (h) actuating the lights and/or the speaker to indicate a score achieved by the player and end the game.

* * * * *